US007942650B2

(12) United States Patent
Kitahara et al.

(10) Patent No.: US 7,942,650 B2
(45) Date of Patent: May 17, 2011

(54) LIQUID DISCHARGE CONTROL APPARATUS INCLUDING A PUMP AND ACCUMULATOR WITH A MOVABLE MEMBER

(75) Inventors: Harunori Kitahara, Hirakata (JP); Tsukasa Hojo, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 872 days.

(21) Appl. No.: 11/718,125

(22) PCT Filed: Dec. 19, 2005

(86) PCT No.: PCT/JP2005/023697

§ 371 (c)(1),
(2), (4) Date: Apr. 27, 2007

(87) PCT Pub. No.: WO2006/068263

PCT Pub. Date: Jun. 29, 2006

(65) Prior Publication Data

US 2009/0196778 A1 Aug. 6, 2009

(30) Foreign Application Priority Data

Dec. 22, 2004 (JP) ..... 2004-372237

(51) Int. Cl.
*F04B 17/00* (2006.01)
*F04B 11/00* (2006.01)
*F16L 55/04* (2006.01)

(52) U.S. Cl. ..... 417/413.2; 417/540; 138/30

(58) Field of Classification Search ..... 417/322, 417/413.2, 413.1, 413.3, 540; 138/30, 31
See application file for complete search history.

(56) References Cited

U.S. PATENT DOCUMENTS 1,796,126 A * 3/1931 Smith ..... 138/30
2,474,512 A * 6/1949 Stephens et al. ..... 138/30
2,773,455 A * 12/1956 Mercier ..... 417/540
3,125,033 A * 3/1964 Marye ..... 417/540

(Continued)

FOREIGN PATENT DOCUMENTS

GB 2203799 10/1988

(Continued)

OTHER PUBLICATIONS

Machine Translation of JP200265963A.*

(Continued)

*Primary Examiner* — Devon C Kramer
*Assistant Examiner* — Nathan Zollinger
(74) *Attorney, Agent, or Firm* — Greenblum & Bernstein, P.L.C.

(57) ABSTRACT

In a liquid discharge control apparatus which uses a piezoelectric type diaphragm pump, an accumulator having a liquid accumulation cavity and a movable member is communicated to an outlet of the diaphragm pump. In discharge operation of the diaphragm pump, a quantity of the liquid in the liquid accumulation cavity is rapidly increased, and the movable member is elastically deformed so as to increase of the volume of the liquid accumulation cavity. Alternatively, in suction operation, when a back stream of the liquid occurs, the quantity of the liquid in a path communicated to the outlet of the diaphragm pump is decreased due to the back stream. The decrease of the liquid can be compensated by the decrease of the volume of the liquid accumulation cavity of the accumulator. Thereby, variation of the quantity of the liquid discharged from the outlet of the accumulator is reduced and the liquid can be discharged, smoothly.

5 Claims, 20 Drawing Sheets

U.S. PATENT DOCUMENTS

| | | | | | |
|---|---|---|---|---|---|
| 3,333,604 | A | * | 8/1967 | Birdwell | 138/30 |
| 3,802,605 | A | * | 4/1974 | Standlick | 222/134 |
| 4,312,382 | A | * | 1/1982 | Gebauer | 138/30 |
| 4,514,151 | A | * | 4/1985 | Anders et al. | 417/540 |
| 4,838,316 | A | * | 6/1989 | Sugimura | 138/30 |
| 4,838,887 | A | * | 6/1989 | Idriss | 604/891.1 |
| 4,903,655 | A | * | 2/1990 | Vonderau et al. | 123/198 C |
| 4,939,405 | A | * | 7/1990 | Okuyama et al. | 310/330 |
| 5,066,282 | A | * | 11/1991 | Wijay et al. | 604/152 |
| 5,171,134 | A | * | 12/1992 | Morgart et al. | 417/540 |
| 5,283,013 | A | * | 2/1994 | Gerhardy | 261/35 |
| 5,816,780 | A | * | 10/1998 | Bishop et al. | 417/322 |
| 5,892,314 | A | | 4/1999 | Sager et al. | |
| 6,033,191 | A | * | 3/2000 | Kamper et al. | 417/322 |
| 6,623,256 | B2 | * | 9/2003 | Takagi et al. | 417/413.2 |
| 6,741,464 | B2 | * | 5/2004 | Kitano et al. | 361/679.53 |
| 6,827,559 | B2 | * | 12/2004 | Peters et al. | 417/413.2 |
| 2004/0001767 | A1 | * | 1/2004 | Peters et al. | 417/413.2 |
| 2007/0048148 | A1 | | 3/2007 | Sakai et al. | |

FOREIGN PATENT DOCUMENTS

| | | | | |
|---|---|---|---|---|
| JP | 50-107507 | | | 8/1975 |
| JP | 63-176679 | | | 7/1988 |
| JP | 63-160402 | | | 10/1988 |
| JP | 63160402 | U | * | 10/1988 |
| JP | 63-275888 | | | 11/1988 |
| JP | 4-314978 | | | 11/1992 |
| JP | 9-225700 | | | 9/1997 |
| JP | 10-075856 | | | 3/1998 |
| JP | 11-281437 | | | 10/1999 |
| JP | 2000-265963 | | | 9/2000 |
| JP | 2000265963 | A | * | 9/2000 |
| JP | 2004-162547 | | | 6/2004 |

OTHER PUBLICATIONS

English Language Abstract of JP 63-176679.
English Language Abstract of JP 2004-162547.
English Language Abstract of JP 10-075856.
English Language Abstract of JP 11-281437.
Partial English Language Translation of JP 63-275888.
English language Abstract of JP 2000-265963, Sep. 26, 2000.
English language translation of JP 50-107507, Aug. 25, 1975.
English language translation of JP 63-160402, Oct. 20, 1988.
English language Abstract of JP 9-225700, Sep. 2, 1997.
English language Abstract of JP 4-314978, Nov. 6, 1992.

* cited by examiner

FIG.1
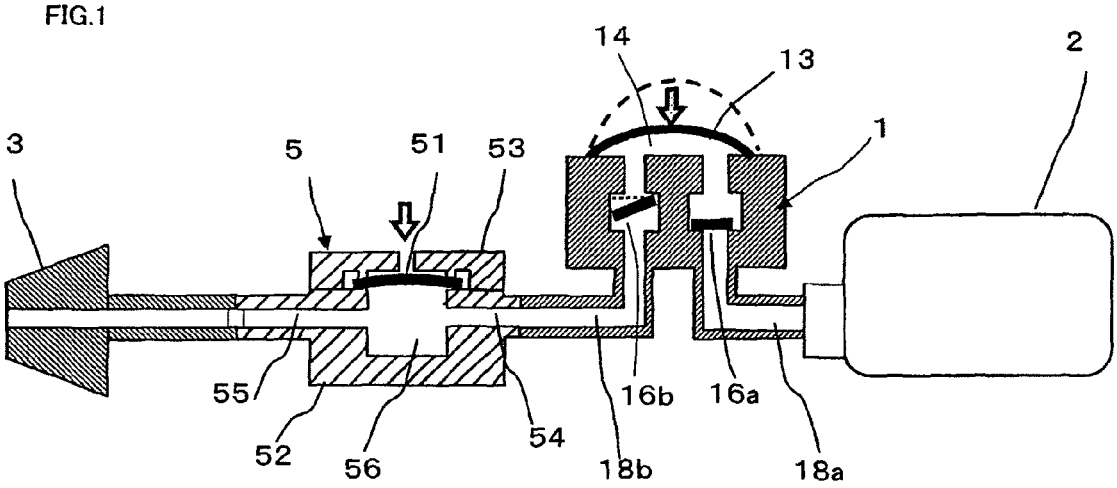
FIG.2A
FIG.2B
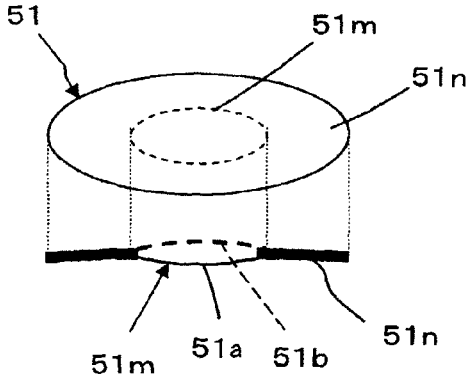

14
13
16c
16d
1
16b
16a 13
1
16b
16a 13
1
16b
16a 13
1
16b
16a 13
1
16b
16a 13
1
16b
16a

LIQUID DISCHARGE CONTROL APPARATUS INCLUDING A PUMP AND ACCUMULATOR WITH A MOVABLE MEMBER

TECHNICAL FIELD

The present invention relates to a liquid discharge control apparatus with a piezoelectric type diaphragm pump which uses a piezoelectric element as a movable member.

BACKGROUND ART

A piezoelectric diaphragm pump sucks working fluid from a suction-valve and discharges the working fluid from an exhaust-valve by increasing and decreasing an inner volume of a pump room due to deformation of a diaphragm of a piezoelectric element. The diaphragm has a pair of electrodes provided on upper and lower faces of a disc shaped piezoelectric member. When a voltage is applied between the electrodes, the piezoelectric member is deformed, so that the diaphragm of the diaphragm pump is deformed, and the working fluid is sucked or discharged. As for the use of the sucking and discharging of the working fluid by the diaphragm pump, feeding of a whit quantity of alcohol to a fuel cell or electrostatic spraying of water can be cited. In these purpose, it is desirable that not only the liquid level configuration (or a face location) of the liquid at a front end of a discharge nozzle but also the rate of flow of the discharged liquid are stable. A suction stroke and a discharge stroke, however, are operated alternately in a reciprocation motion pump such as diaphragm pump, so that a pulsating quantity of the discharged liquid generally becomes larger. On the other hand, in a pump using a passive valve, back stream occurs due to switching action of the valve. Such a back stream can be reduced by using an active valve, but it causes an increase of cost.

Japanese Laid-Open Patent Publication No. 63-275888 discloses a conventional apparatus for preventing occurrence of pulsation in liquid flowing in a pipe arrangement with using a diaphragm, plunger or gear pumps. Such a conventional apparatus is comprised of a flexible pipe or flexible hollow ball member, and an elastic member for restricting a cross-section area of an aperture the pipe or the hollow ball member. When the liquid is flown with a pressure, the elastic member is deformed to vary the cross-section area of the aperture the pipe or the hollow ball member corresponding to the pressure of the liquid, so that the variation of the pressure of the liquid can be absorbed. The response of the elastic member to the variation of the pressure, however, is slower, so that the variation of the inner volume of the flexible pipe or hollow ball member is slower. Consequently, such a conventional apparatus can respond to only relatively large pulsation but cannot respond to minute back stream.

In addition, Japanese Laid-Open Patent Publication No. 10-75856 discloses a conventional pump apparatus having a long flexible tube provided in a path from an air pump to a pressing pipe arrangement and having predetermined inner dimensions in natural state. When a pressure acts on the inside of the flexible tube, it is expanded by the pressure, so that the pulsation of the liquid flow can be reduced. Since the pump apparatus uses the flexible tube, it cannot be respond to the minute back stream.

Furthermore, Japanese Laid-Open Patent Publication No. 11-281437 discloses a conventional flowmeter which absorbs pulsation of liquid flow so as to measure a rate of flow precisely. The flowmeter, however, is not assumed the back stream, at all.

DISCLOSURE OF INVENTION

The present invention is contrived to solve the problems of the above-mentioned conventional apparatuses, and purposed to provide a liquid discharge control apparatus using a piezoelectric type diaphragm pump which can largely decrease the pulsation of liquid flow.

A liquid discharge control apparatus in accordance with an aspect of the present invention comprises: a piezoelectric type diaphragm pump having a control valve which is opened and closed by pressure difference and a piezoelectric element serving as driving actuator; and an accumulator communicated to an outlet of the diaphragm pump, and having a liquid accumulation cavity and a moving member which has two equilibration points in elastic deformation and is elastically deformed between the equilibration points by variation of quantity of the liquid flowing into the liquid accumulation cavity so as to increase and decrease a volume of the liquid accumulation cavity corresponding to increase and decrease of the quantity of the liquid, thereby variation of quantity of the liquid discharged from the accumulator can be reduced.

According to such a configuration, when the control valve of the diaphragm pump is opened in discharge operation of the liquid, the quantity of the liquid in a path communicated to the outlet of the diaphragm pump is rapidly increased, and the increase of the quantity of the liquid can be absorbed by the increase of the volume of the liquid accumulation cavity of the accumulator. Alternatively, when the control valve of the diaphragm pump is closed in suction operation of the liquid, a back stream of the liquid which flows toward the diaphragm pump occurs in the path communicated to the outlet of the diaphragm pump. Although the quantity of the liquid in a path communicated to the outlet of the diaphragm pump is decreased due to occurrence of the back stream, the decrease of the liquid which is to be discharged from an outlet of the accumulator can be compensated by the decrease of the volume of the liquid accumulation cavity of the accumulator. Thereby, variation of the quantity of the liquid discharged from the outlet of the accumulator is reduced and the liquid can be discharged, smoothly.

Since the movable member of the accumulator has two equilibration points in the elastic deformation where the movable member is rarely deformed, the movable member is deformed or displaced between these two equilibration points by the variation of the quantity or pressure of the liquid in the liquid accumulation cavity of the accumulator. Thus, the deformation or displacement of the movable member can be performed quickly and smoothly.

BRIEF DESCRIPTION OF DRAWINGS

FIG. 1 is a sectional view showing a schematic configuration of the liquid discharge control apparatus in accordance with a first embodiment of the present invention.

FIG. 2A is a plan view or a perspective view showing a configuration of a movable member of an accumulator used in the liquid discharge control apparatus in the first embodiment.

FIG. 2B is a sectional view showing two equilibration states of elastic deformation of the movable member.

BEST MODE FOR CARRYING OUT THE INVENTION

First Embodiment

Figure 3:
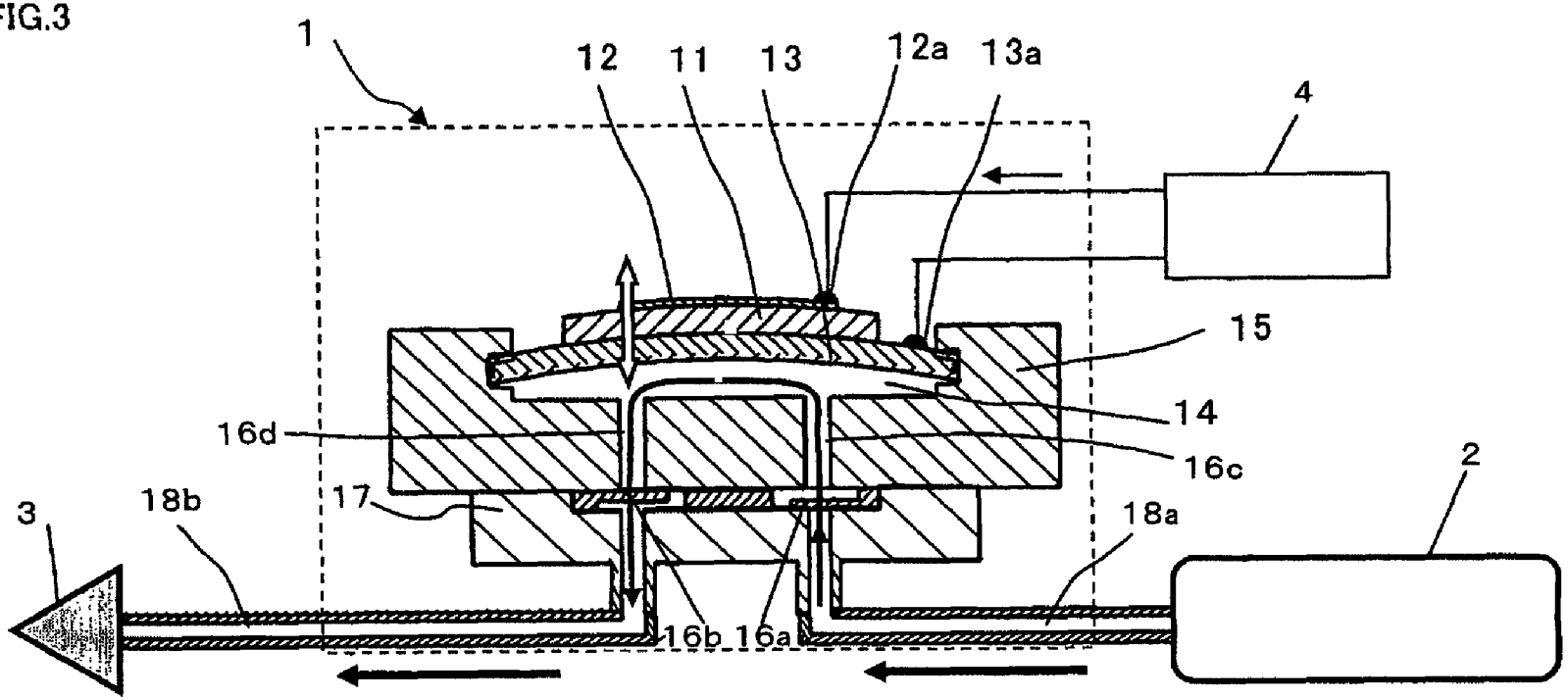
FIG. 3 is a sectional view showing a detailed configuration of a piezoelectric type diaphragm pump used in the liquid discharge control apparatus in the first embodiment.

A liquid discharge control apparatus with a piezoelectric type diaphragm pump in accordance with a first embodiment of the present invention is described with reference to FIGS. 1, 2A and 2B. FIG. 1 shows a sectional schematic configuration of the liquid discharge control apparatus in the first embodiment. The liquid discharge control apparatus comprises a piezoelectric type diaphragm pump 1, a liquid tank 2 into which a liquid to be discharged is contained, a nozzle 3 from which the liquid is discharged, and an accumulator (first accumulator) 5 provided between the diaphragm pump 1 and the nozzle 3 for reducing back stream generated in the diaphragm pump 1.

The diaphragm pump 1 comprises a diaphragm plate (piezoelectric actuator) 13 which is driven by a driving force of a piezoelectric element, a suction valve 16*a* and a discharge valve (control valve) 16*b* which are alternately opened and closed by flowing direction of a liquid and a pressure difference. Since a volume of an inner space 14 of the diaphragm pump 1 is varied corresponding to deformation of the diaphragm plate 13, the suction valve 16*a* and the discharge valve 16*b* are alternately opened and closed by pressure difference caused by the variation of the volume of the inner space 14, thereby the liquid contained in the liquid tank 2 can be discharged from the nozzle 3. The suction valve 16*a* is provided between a suction pipe arrangement 18*a* and the inner space 14, and the discharge valve 16*b* is disposed between the inner space 14 and a discharge pipe arrangement 18*b*. When pump 1 is in suction motion, the discharge valve 16*b* is closed, but back stream occurs in a direction opposite to the discharge direction of the liquid.

The accumulator 5 comprises a movable member which is a disc shaped elastic diaphragm and deformed by a pressure of the liquid flown from the diaphragm pump 1, a housing 52, a liquid accumulation cavity 56 into which the liquid flown from the diaphragm pump 1 is temporarily accumulated, and a cramp member 53 for folding a movable member 51. The movable member 51 is established in an initial state where it is previously concaved. The liquid accumulation cavity 56 is communicated to an inlet 54 and an outlet 55. The movable member 51 which is deformed by the pressure of the liquid has two equilibration points of the elastic deformation. Since the movable member 51 is moved between these equilibration points corresponding to the variation of the pressure of the liquid, it reduces the back stream due to the motion of the discharge valve 16*b*. As for the movable member 51, an elastic membrane is used as an example. The movable member, however, is not limited to the elastic membrane, and various kinds of elastic materials can be used corresponding to the use and/or capability of the diaphragm pump in the present invention.

In the accumulator 5, when the quantity or pressure of the liquid flowing in the liquid accumulation cavity 56 is reduced due to the back stream, the movable member 51 is deformed from the initial state as shown by arrow in FIG. 1B so as to reduce the volume of the liquid accumulation cavity 56, and the liquid in the liquid accumulation cavity 56 is forcibly discharged. Thereby, reduction of the quantity of the liquid due to the back stream generated by the motion of the discharge valve 16*b* is compensated by the quantity of the liquid forcibly discharged by the deformation of the movable member 51. Alternatively, when the pressure drop of the liquid flow due to the back stream is evaporated, the movable member 51 recovers to the initial state. In this way, the movable member 51 controls the volume of the liquid in the liquid accumulation cavity 56, so that the liquid can be discharged smoothly from the outlet 55.

As shown in FIGS. 2A and 2B, the movable member 51 of the accumulator 5 is constituted by an elastic film made of a flexible material, and has a center portion 51*m* which can be elastically deformed by the pressure of the liquid and a peripheral portion 51*n* fixed on the housing 52 by the clamp member 53. The center portion 51*m* has an initial equilibration state 51*a* illustrated by a solid line in FIG. 2B which is previously concaved in a predetermined direction and a deformed equilibration state 51*b* illustrated by a dotted line in FIG. 2B which is previously convexed in the opposite direction. Hereupon, the equilibration state in the first embodiment is defined as a state where the movable member 51 is elastically deformed and it is stopped by balancing the elastic force of the movable member 51 with an external force applied to the movable member 51. In the equilibration state, the movable member is not necessarily elastically deformed.

The equilibration state 51*a* of the movable member 51 corresponds to the state where the pressure of the liquid flow is lower due to the occurrence of the back stream and the volume of the liquid accumulation cavity 56 becomes the smallest. The equilibration state 51*b* of the movable member 51 corresponds to the state where the pressure of the liquid flow is higher due to no back stream and the volume of the liquid accumulation cavity 56 becomes the largest. When the movable member 51 takes one of these two equilibration states 51*a* and 51*b*, the elastic deformation in each equilibration state is substantially zero, so that the volume of the equilibration state 51*a* becomes constant.

The movable member 51 is made so that the expansion and contraction of the elastic film in itself small and the elastic deformation in each equilibration state is substantially zero, and thereby the pulsation of the liquid flow in the equilibration state rarely occurs. Thereby, the movable member 51 can be moved quickly between the equilibration states 51*a* and 51*b*. By such a quick response of the movable member 51, the accumulator 5 can respond to a minute variation of the quantity of the liquid flow due to the occurrence or evaporation of the back stream, so that influence of the back stream can be reduced. Although the center portion 51*m* of the movable member 51 is formed previously to be concaved in a predetermined direction in the first embodiment, it is possible to form the center portion previously as flat shape and deformed concave or convex by the variation of the pressure of the liquid flow even though it can take two equilibration states.

In the liquid discharge control apparatus configured above, when the diaphragm pump 1 is driven, the liquid contained in the liquid tank 2 flows into the inner space 14 through the suction pipe arrangement 18*a* and the suction valve 16*a* and further flows to the accumulator 5 through the discharge valve 16*b* and the discharge pipe arrangement 18*b* includes an influence due to occurrence and evaporation of the back stream generated by the open and close of the discharge valve 16*b*. The movable member 51 of the accumulator 5 responds ti the variation of the pressure of the liquid flow due to the occurrence and evaporation of the back stream, so that the quantity of the liquid discharged from the nozzle 3 can be controlled to be substantially constant.

Subsequently, detailed configuration of the piezoelectric type diaphragm pump 1 is described with reference to FIGS. 3, 4A and 4B, 5A and 5B, 6A to 6D, and 7A to 7C. FIG. 3 shows a configuration of the piezoelectric type diaphragm pump 1. The diaphragm pump 1 comprises a flat plate shaped piezoelectric element 11 having an electrode 12 made of a conductive material, a diaphragm plate 13 made of a conductive material, fixed to the piezoelectric element 11 and elastically deformed corresponding to a deformation of the piezoelectric element 11, a housing 15 having an inner space 14 formed below the diaphragm plate 13 and an inlet 16*c* and an outlet 16*d* communicated to the inner space 14, and a control circuit 4 for driving the piezoelectric element 11. The control circuit 4 applies a voltage between a terminal 12*a* provided on the electrode 12 and a terminal 13*a* provided on the diaphragm plate 13 so as to control the suction and discharge of the diaphragm pump 1 by deforming the piezoelectric element 11.

The diaphragm plate 13 is, for example, a circular disc made of a brass, and a circular disc shaped piezoelectric element (PZT) 11 is adhered on the diaphragm plate 13. The housing 15 is, for example, made. of a plastic material such as a polyacetal (POM), poly carbonate (PC), or poly phenyl styrene (PPS). The diaphragm plate 13 with the piezoelectric element 11 is fixed on the housing 15. For example, the piezoelectric element 11 had s diameter of 10 mm and a thickness of 0.2 mm. The diaphragm plate 13 has a diameter of 20 mm and a thickness of 0.2 mm. The housing 15 has a concavity of a top face aperture to form the inner space 14.

The diaphragm plate 13 is mounted on the housing 15 so as to be warped outward opposite to the inner space 14 in an initial state that no voltage is applied to the piezoelectric element 11.

A suction valve 16*a* and a discharge dialect 16*b* are respectively provided to be communicated with the inlet 16*c* and the outlet 16*d*. These valves 16*a* and 16*b* are disposed between the housing 15 and a valve guard 17. As for a structure of each valve, it is possible to use a cantilevered valve which is opened and closed by pressure difference between the pressure at front of the valve and the pressure at the back of the valve.

Figure 4A:
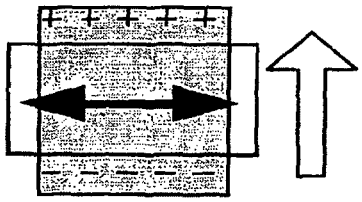
FIG. 4A is a schematic view showing a deformation of a piezoelectric element when a voltage is applied to it in a reverse direction.
Figure 4B:
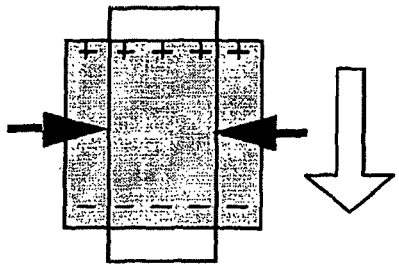
FIG. 4B is a schematic view showing a deformation of the piezoelectric element when a voltage is applied to it in a forward direction.

FIG. 4A schematically shows a deformation of the piezoelectric element 11 when a voltage is applied to it in a reverse direction, and FIG. 4B schematically shows a deformation of the piezoelectric element 11 when a voltage is applied to it in a forward direction. Hereupon, symbols "+" and "−" respectively designate polarization. When a voltage is applied to the piezoelectric element 11, an electric field occurs in thickness direction of the piezoelectric element 11 as shown by arrow on a colored background, so that the piezoelectric element 11 deforms in widthwise direction shown by black arrow by such electric field. When the negative voltage is applied to the piezoelectric element 11 so that the direction of the electric field becomes opposite to the direction of polarization, as shown in FIG. 4A, the piezoelectric device 11 contracts in the thickness direction, and expands in the widthwise direction. Alternatively, when the positive voltage is applied to the piezoelectric element 11 so that the direction of the electric field becomes the same as the direction of polarization, as shown in FIG. 4B, the piezoelectric device 11 expands in the thickness direction, and contracts in the widthwise direction. By applying alternating voltage or pulsating voltage to the piezoelectric element 11, the piezoelectric element 11 repeats the expansion and contraction in the thickness direction, so that the diaphragm plate 13 of the diaphragm pump 1 is oscillated. Thereby, the diaphragm pump 1 is driven for pump action.

Figure 5A:
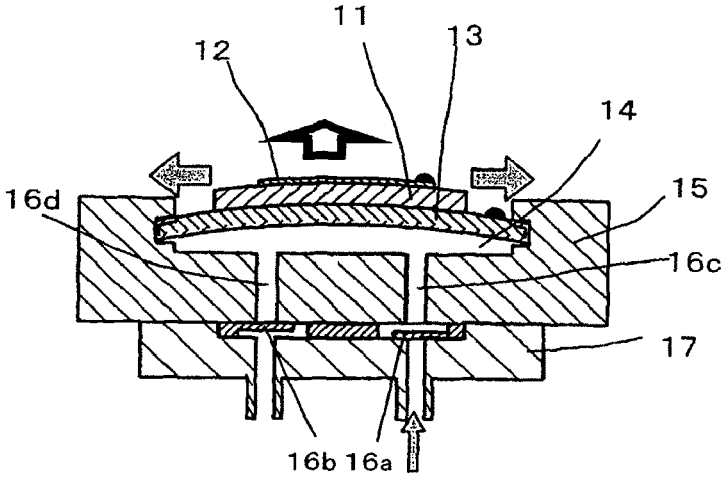
FIG. 5A is a sectional view showing an initial state that no voltage is applied to the piezoelectric element and a diaphragm plate of a diaphragm pump is not warped in the first embodiment.
Figure 5B:
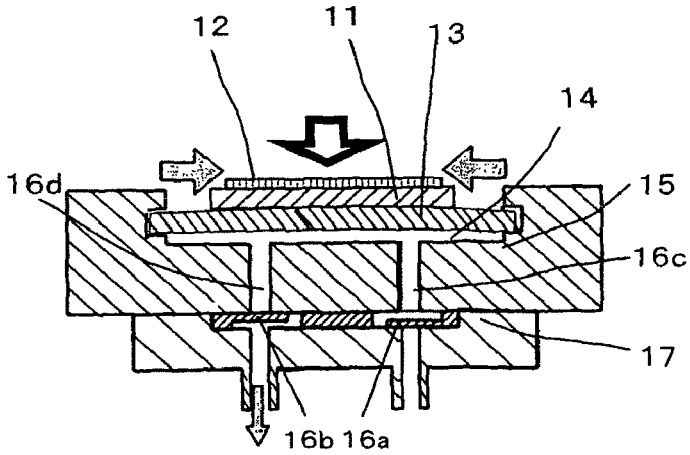
FIG. 5B is a sectional view showing a state that a predetermined voltage is applied to the piezoelectric element and the diaphragm plate is warped corresponding to the deformation of the piezoelectric device in the first embodiment.

Subsequently, a motion of the piezoelectric type diaphragm pump 1 is described with reference to FIGS. 5A and 5B. FIG. 5A shows an initial state of the piezoelectric type diaphragm pump 1 where no voltage is applied to the piezoelectric element 11. When a positive voltage is applied to the piezoelectric element 11 in the initial state shown in FIG. 5A, the piezoelectric element 11 contracts in the widthwise direction thereof. The diaphragm plate 13, however, does not contract or expand, so that the diaphragm pump 13 is deformed to reduce a quantity of warp corresponding to the deformation of the piezoelectric element 11, as shown in FIG. 5B. Thereby, the volume of the inner space 14 is decreased, so that the pressure in the inner space 14 is increased. Thereby, the suction valve 16*a* is closed and the discharge valve 16*b* is opened. Consequently, the liquid in the inner space 14 is discharged from the outlet 16*d*. The diaphragm pump 1 performs the discharge operation.

When the voltage applied to the piezoelectric element 11 is varied to the grounding voltage from the state that the positive voltage is applied to the piezoelectric element 11, the piezoelectric element 11 and the diaphragm plate 13 restore to the original states by restorative forces of themselves, as shown in FIG. 5A. In other words, the quantity of warp of the diaphragm plate 13 increases, and thereby the volume of the inner space 14 is increased. Thus, the pressure in the inner space 14 decreases, so that the discharge valve 16*b* is closed and the suction valve 16*a* is opened. Consequently, the liquid is sucked into the inner space 14. The diaphragm pump 1 performs the suction operation. For example, the voltage applied to the piezoelectric element 11 is an alternating voltage varied between +120 V to 0 V. When the voltage +120 V is applied to the piezoelectric element, the diaphragm pump 1 performs the discharge operation, and when the voltage 0 V is applied to the piezoelectric element, the diaphragm pump 1 performs the suction operation. Driving frequency of alternation of the voltage applied to the piezoelectric element 11 is different corresponding to the viscosity of the working fluid. For example, in case that the working fluid is water and a diameter of the pipe arrangement is 1 mm, the driving frequency may be about 40 Hz.

Figures 6A, 6B, 6C, 6D, 6E, 6F:
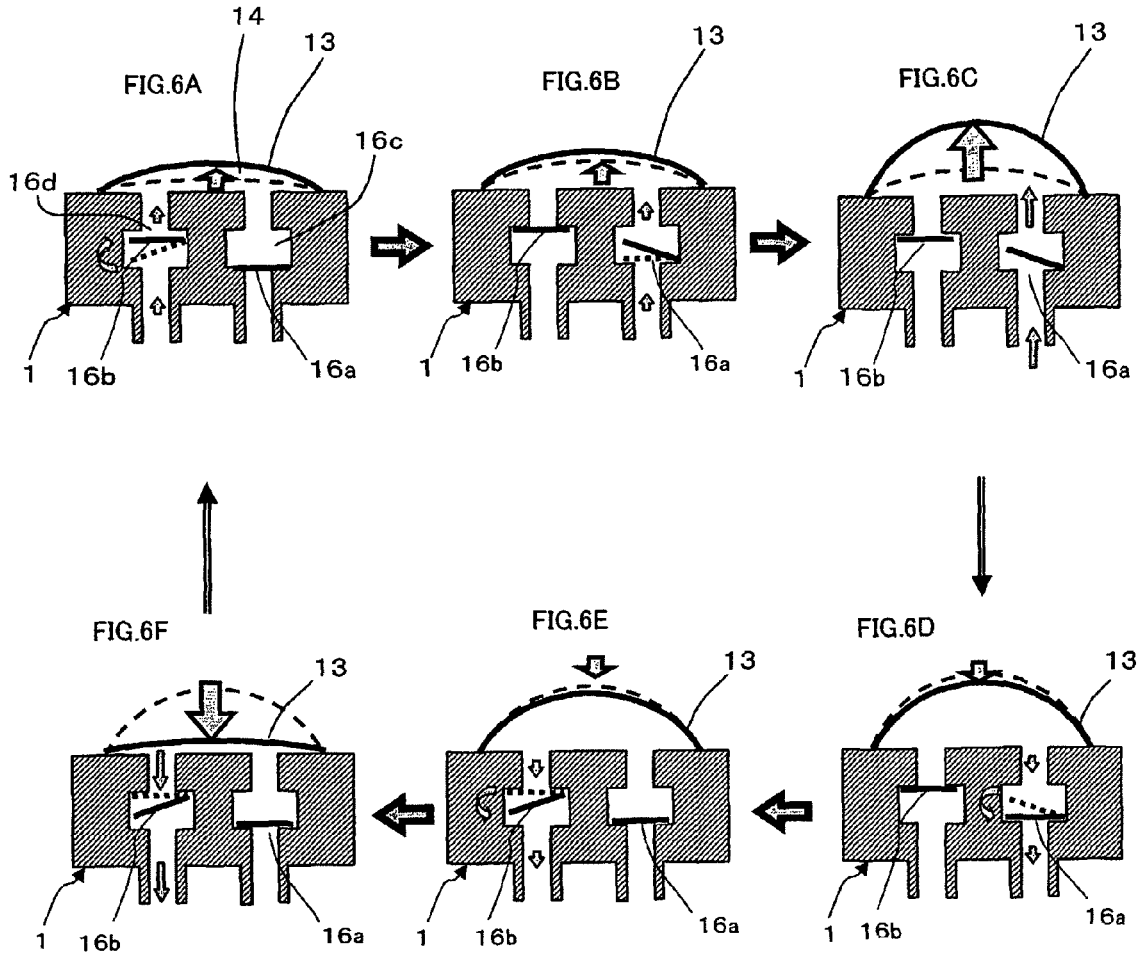
FIGS. 6A to 6C are sectional views respectively showing suction operation of the diaphragm pump in the first embodiment.
FIGS. 6D to 6F are sectional views respectively showing discharge operation of the diaphragm pump in the first embodiment.

Subsequently, the suction and discharge operations by the diaphragm pump 1 are described in detail with reference to FIGS. 6A to 6F. FIGS. 6A to 6C show the suction operation, where the discharge valve 16*b* is closed and the suction valve 16*a* is opened by the expanding warp of the diaphragm plate 13 so that the liquid is sucked into the inner space 14 of the diaphragm pump 1. FIGS. 6D to 6F show the discharge operation, where the suction valve 16*a* is closed and the discharge valve 16*b* is opened by the contraction warp of the diaphragm plate 13 so that the liquid in the inner space 14 of the diaphragm pump 1 is discharged outside.

When the driving frequency of the alternating voltage applied to the piezoelectric element 11 is higher, the discharge valve 16*b* has been opened and the suction valve 16*a* has been closed while the operation state shifts from the discharge operation shown in FIG. 6F to the suction operation shown in FIG. 6A. When a voltage is applied to the piezoelectric element 11, the diaphragm plate 13 is deformed corresponding to the expansion or contraction of the piezoelectric element 11, so that the volume of the inner space 14 is gradually increased, and thereby, the discharge valve 16*b* is closed, as shown in FIG. 6A. Following to the closing motion of the discharge valve 16*b*, a small quantity of the liquid reversely flows into the inner space 14 from the outlet 16*d*.

Figure 7A:
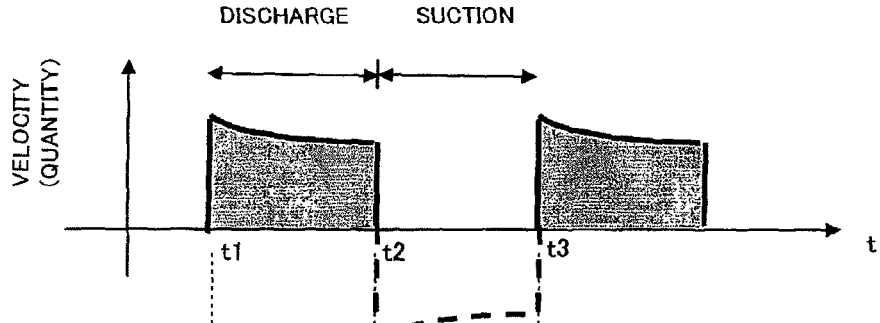
FIG. 7A is a graph showing instantaneous flow velocity of a working fluid discharged from the diaphragm pump when a pulsating voltage is applied to the piezoelectric element of the diaphragm pump.

Subsequently, a variation of the working fluid discharged from the diaphragm pump 1 when a pulsating voltage is applied to the piezoelectric element 11 is described with reference to FIGS. 7A to 7C. FIG. 7A shows instantaneous flow velocity of a working fluid discharged from the diaphragm pump 1 when the pulsating voltage is applied to the piezoelectric element 11. Hereupon, the voltage applied to the piezoelectric element 11 is a pulsating voltage of 120 V having a duty ratio 50%. In one cycle of the pulsating voltage (in a term t1 to t3) in FIG. 7A, a large quantity of liquid is instantaneously flows at a time t1, but the instantaneous flow velocity of the liquid in a discharge term (t1 to t2) becomes substantially constant. In a suction term (t2 to t3), since the liquid is not discharged, the flow velocity of the liquid becomes zero.

Figure 7B:
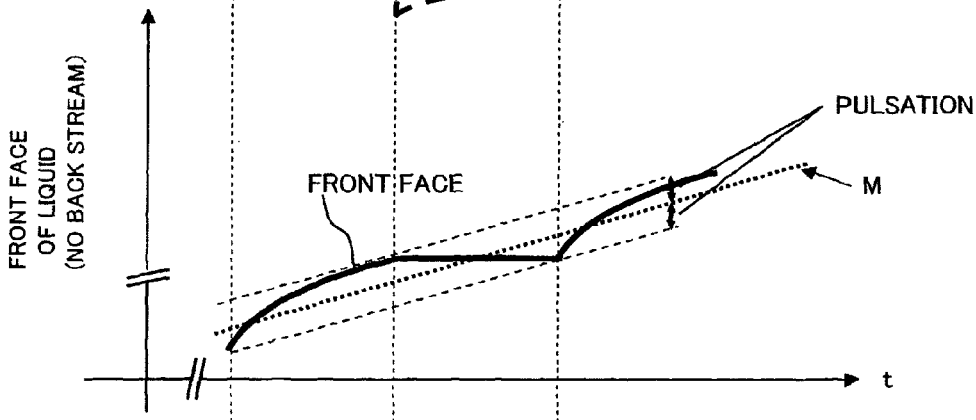
FIG. 7B is a graph showing a variation of a front face of a liquid discharged from a nozzle of the liquid discharge control apparatus when no back stream occurs.

FIG. 7B shows a variation of a front face of the liquid discharged from the nozzle 3 of the liquid discharge control apparatus when no back stream occurs. Hereupon, the front face of the liquid is defined as the position of the front face of the liquid in the center of the pipe arrangement. As can be seen from FIG. 7B, the front face of the liquid moved during the discharge operation and stops during the suction operation. Average position of the front face of the liquid is shown by dotted line "M" in the FIG. 7B, and a quantity of pulsation of the liquid can be designated by divergence of the actual position of the front face of the liquid from the average position. The largest value of the quantity of pulsation of the liquid becomes a quarter of a volume of the liquid discharged in one oscillation, when the duty ration of the pulsating voltage is 50%.

Figure 7C:
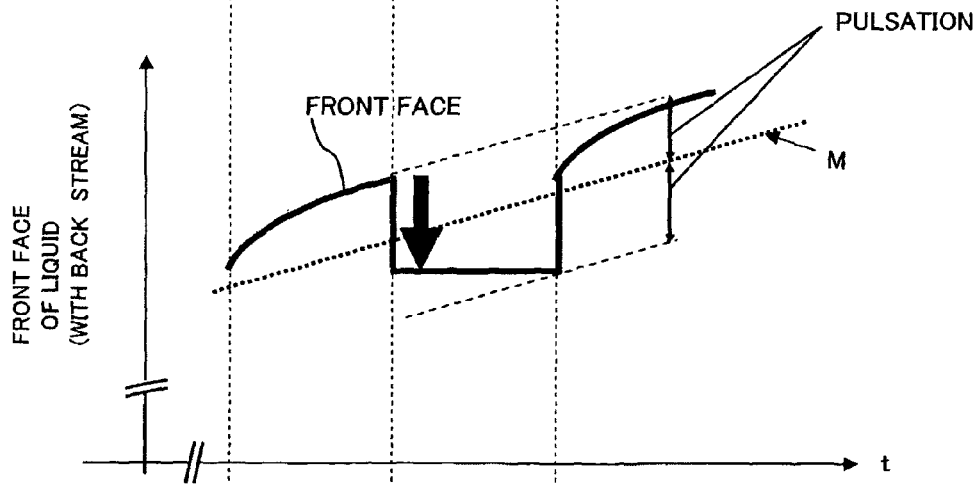
FIG. 7C is a graph showing a variation of a front face of a liquid discharged from a nozzle of the liquid discharge control apparatus when back stream occurs.

On the other hand, FIG. 7C shows the variation of the front face of the liquid discharged from the nozzle 3 of the liquid discharge control apparatus when back stream occurs. In this case, the average position of the front face of the liquid is backed down by a half of a volume of the liquid of back stream from the most forward position of the front face of the liquid. Therefore, the largest value of the quantity of pulsation of the liquid becomes a sum of a quarter of a volume of the liquid discharged in one oscillation and a half of a volume of the liquid of the back stream. Since the volume of the liquid of the back stream has no relation to the frequency of the oscillation, so that it directly influences the quantity of pulsation of the liquid.

Figure 8A:
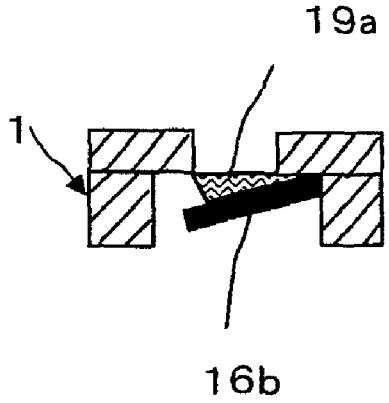
FIG. 8A is a sectional view showing a state before closing a discharge valve of the diaphragm pump.
Figure 8B:
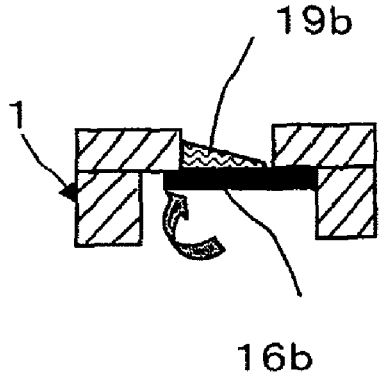
FIG. 8B is a sectional view showing a state after closing the discharge valve of the diaphragm pump.

Subsequently, the flow of the liquid before and after of the open and close of the discharge valve 16*b* of the diaphragm pump 1 is described with reference to FIGS. 8A and 8B. When the discharge valve 16*b* is operated from the opened state shown in FIG. 8A to the closed state shown in FIG. 8B, a part of the liquid 19*a* is flown backward corresponding to the motion of the discharge valve 16*b*, so that the liquid flown backward becomes the back stream to the inner space 14 of the diaphragm pump 1.

Figure 9:
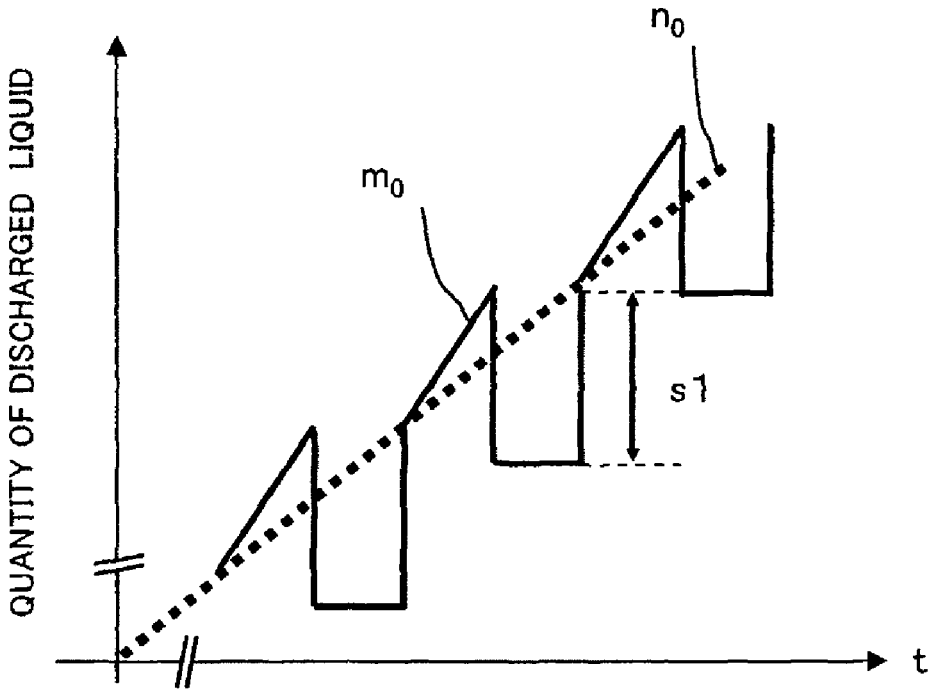
FIG. 9 is a graph showing variation of a quantity of liquid discharged from the diaphragm pump when no accumulator is provided.

Variation of a quantity of the discharged liquid in the pipe arrangement 18*b* of the diaphragm pump 1 when it is assumed that the accumulator 5 is not provided is described with reference to FIG. 9. When a predetermined voltage is applied to the piezoelectric element 11 of the diaphragm pump 1, the liquid is discharged from the diaphragm pump 1. Alternatively, when the voltage is applied to the piezoelectric element 11 becomes 0 V, the liquid is sucked into the diaphragm pump 1. During the suction of the liquid, the back stream of the liquid occurs, so that the quantity $m_o$ of the discharged liquid is decreased corresponding to the quantity s1 of the back stream of the liquid backwardly flown into the inner space 14 of the diaphragm pump 1. Consequently, the pulsation due to the back steam occurs in the working fluid in the pipe arrangement 18*b*. In FIG. 9, a symbol $n_o$ designates a quantity of the discharged liquid in an appearance.

Figure 10A:
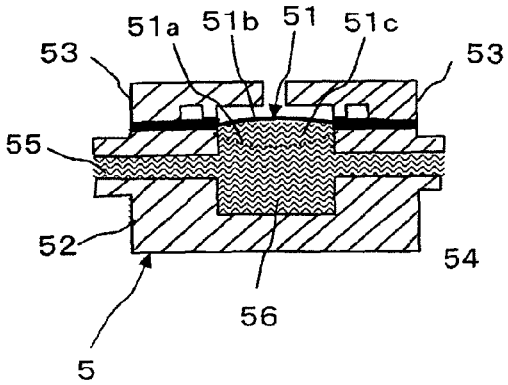
FIG. 10A is a sectional view showing a state that a volume of a liquid accumulation cavity of an accumulator is increased.
Figure 10B:
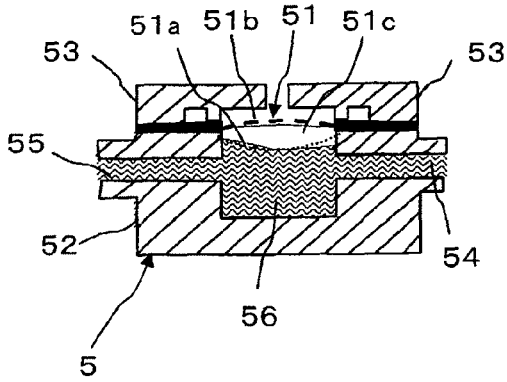
FIG. 10B is a sectional view showing a state that the volume of the liquid accumulation cavity of the accumulator is decreased.

Subsequently, the operation of the accumulator 5 is described with reference to FIGS. 10A and 10B. FIGS. 10A and 10B respectively show the states that the volume of the liquid accumulation cavity 56 of the accumulator 5 is increased and decreased by the elastic deformation of the movable member 51 due to the occurrence and evaporation of the back stream.

In the discharge operation of the diaphragm pump 1, the movable member 51 of the accumulator 5 shifts the equilibration state 51*b* from the initial equilibration state 51*a* by warping the center portion 51*m* thereof outward. When the quantity of the liquid flowing in the accumulator 5 is increased by the discharge operation of the diaphragm pump 1, the pressure of the liquid in the liquid accumulation cavity 56 of the accumulator 5 is increased so that the center portion 51*m* of the movable member 51 is elastically deformed to warp outward. When the center portion 51*m* of the movable member 51 is deformed at a maximum, the volume of the liquid accumulation cavity 56 of the accumulator 5 becomes the largest and the movable member 51 is held in the equilibration state 51*b*. Thereby, the variation of the quantity of the discharged liquid is restricted in the discharge operation. Similarly, in the suction operation of the diaphragm pump 1, the center portion 51*m* of the movable member 51 is warped inward, so that the volume of the liquid accumulation cavity 56 of the accumulator 5 is decreased. When the center portion 51*m* of the movable member 51 is deformed at a minimum, the volume of the liquid accumulation cavity 56 of the accumulator 5 becomes the smallest and the movable member 51 is held in the equilibration state 51*a*. Thereby, the variation of the quantity of the discharged liquid due to the occurrence of the back stream is absorbed in the suction operation. Consequently, the liquid is uniformly discharged from the outlet 55 of the accumulator 5.

Figure 11:
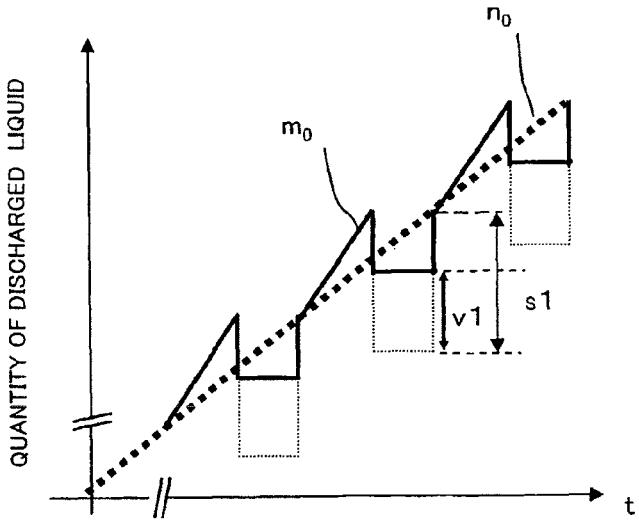
FIG. 11 is a graph showing variation of a quantity of liquid discharged from the diaphragm pump when an accumulator is provided.

FIG. 11 shows variation of the discharged liquid when the accumulator 5 is provided. In comparison with FIGS. 9 and 11, the quantity of the discharged liquid which is decreased due to the occurrence of the back stream is reduced by a quantity v1 from the quantity s1 when the accumulator 5 is not provided.

According to the liquid discharge control apparatus in the first embodiment, the movable member 51 of the accumulator 5 has two equilibration states in the elastic deformation, and the elastic deformation of the movable member 51 in each equilibration state is made substantially zero, so that the movable member 51 can be shifted between these two equilibration states quickly. Thereby, it is possible to reduce the influence of the back stream in the liquid flow discharged from the diaphragm pump 1. Furthermore, even when the quantity of the back stream of the liquid generated by the motion of the discharge valve 16*b* of the diaphragm pump 1 is smaller, it is possible to make the flow of the discharged liquid smooth.

The conventional accumulator used for absorbing the variation of the pressure of the liquid is not generally considered the back stream due to the discharge valve, so that the variation of the volume of the accumulator is much larger than the quantity of the back stream of the liquid. Therefore, it is not sufficient to respond to a minute variation of the volume for absorbing the minute back stream. Furthermore, the accumulator having a large variation of the volume cannot absorb the pulsation component due to the minute back stream of the discharge valve. The accumulator 5 in the first embodiment, however, can solve the above-mentioned problems.

Second Embodiment

Figure 12:
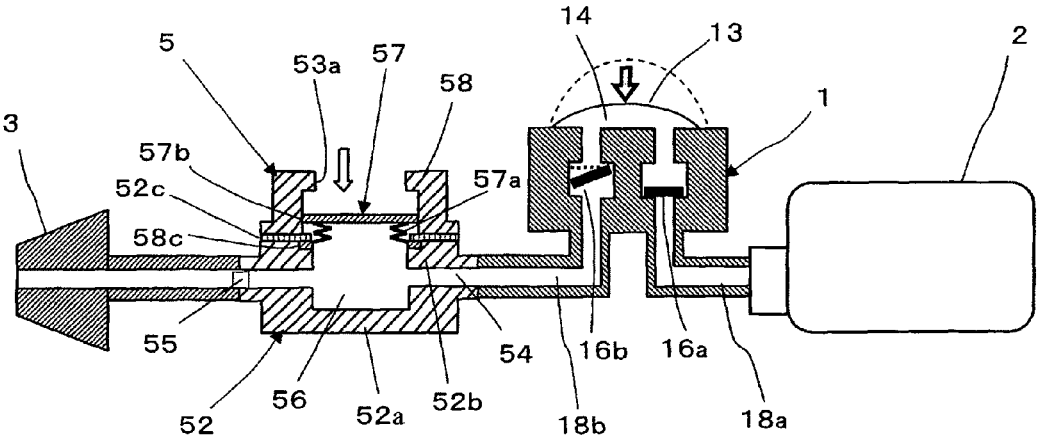
FIG. 12 is a sectional view showing a schematic configuration of the liquid discharge control apparatus in accordance with a second embodiment of the present invention.
Figure 13A:
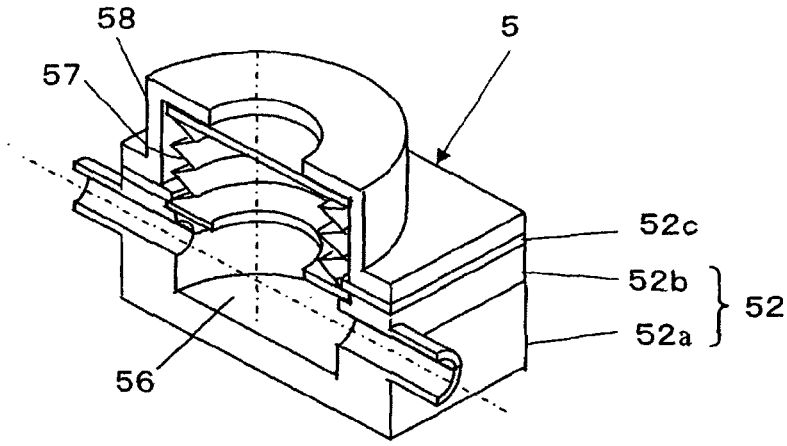
FIG. 13A is a sectional perspective view showing a configuration of an accumulator in the second embodiment.
Figure 13B:
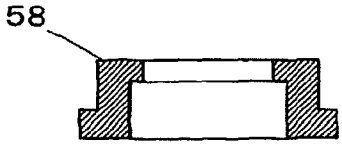
FIGS. 13B to 13F are sectional views respectively showing configurations of elements constituting the accumulator in the second embodiment.
Figure 13C:
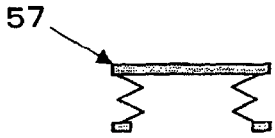
Figure 13D:
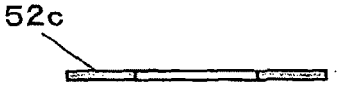
Figure 13E:
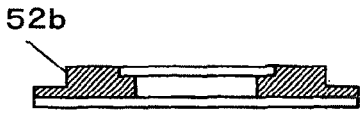
Figure 13F:
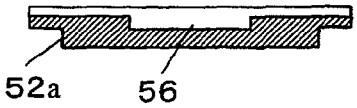
Figure 13G:
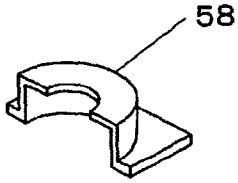
FIGS. 13G to 13K are sectional perspective views respectively showing configurations of the elements constituting the accumulator in the second embodiment.
Figure 13H:
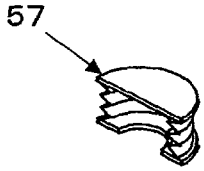
Figure 13I:
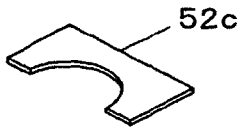
Figure 13J:
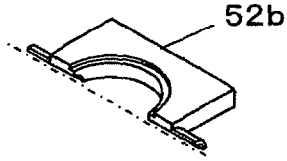
Figure 13K:
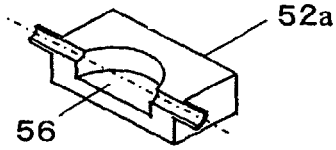

A liquid discharge control apparatus with piezoelectric type diaphragm pump in accordance with a second embodiment of the present invention is described with reference to FIGS. 12, 13A to 13K, 14A and 14B. In the second embodiment, a bellows type movable member 57 having a periphery wall is used for the movable member of the accumulator 5 as shown in FIG. 12. Since the configuration of the liquid discharge control apparatus in the second embodiment is substantially the same as that in the first embodiment except the movable member 57, the description of the common configuration with the first embodiment is omitted.

In the second embodiment, the pulsation of the liquid discharged from the diaphragm pump 1 due to the back stream generated by the motion of the discharge valve 16*b* is restricted by the accumulator 5 having the bellows type movable member 57.

As shown in FIG. 13A to 13K, the accumulator 5 comprises a housing 52 configured by a lower housing member 52*a* and an upper housing member 52*b*, a liquid accumulation cavity 56 provided on the lower housing member 52*a* into which the liquid flown from the diaphragm pump 1 is temporarily accumulated, the bellows type movable member 57 which serves as an elastic diaphragm moved by pressure of a liquid flown into the accumulator 5, and a stopper 58 for restricting the movement of the bellows type movable member 57. The accumulator 5 constitutes a circular diaphragm.

The bellows type movable member 57 has a periphery wall inner face of which is shaped like bellows, and the bottom of the periphery wall is fixed to a bellows guide 52*c*. The bellows guide 52*c* is nipped between the stopper 58 and the upper housing member 52*b*. The bellows type movable member 57 is deformed by variation of the pressure of the liquid flown into the accumulator 5, and the movement of the bellows type movable member 57 in a direction of the expansion and contraction thereof is restricted by the stopper 58, so that the bellows type movable member 57 has two equilibration states and is movable between these two equilibration states.

Figure 14B:
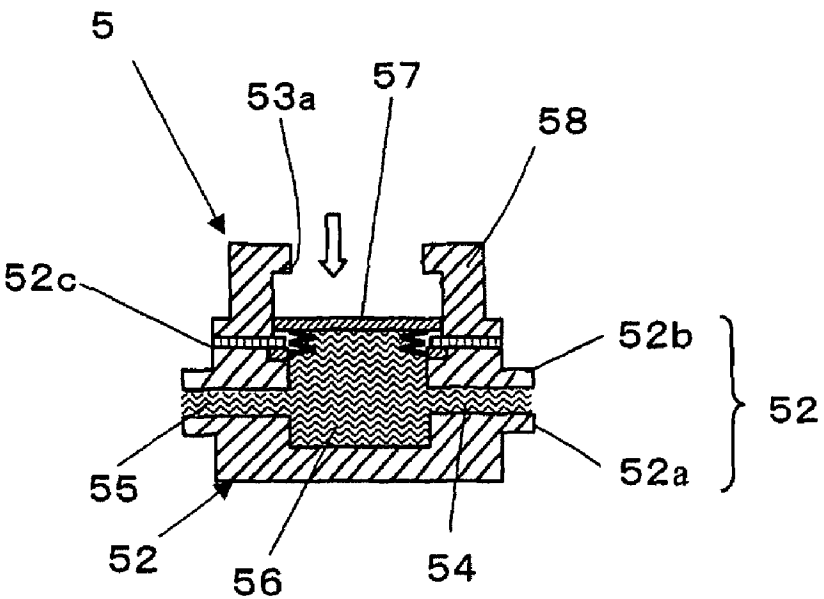
FIG. 14B is a sectional view showing a state that the bellows shaped movable member of the accumulator is contracted in the second embodiment.
Figure 14A:
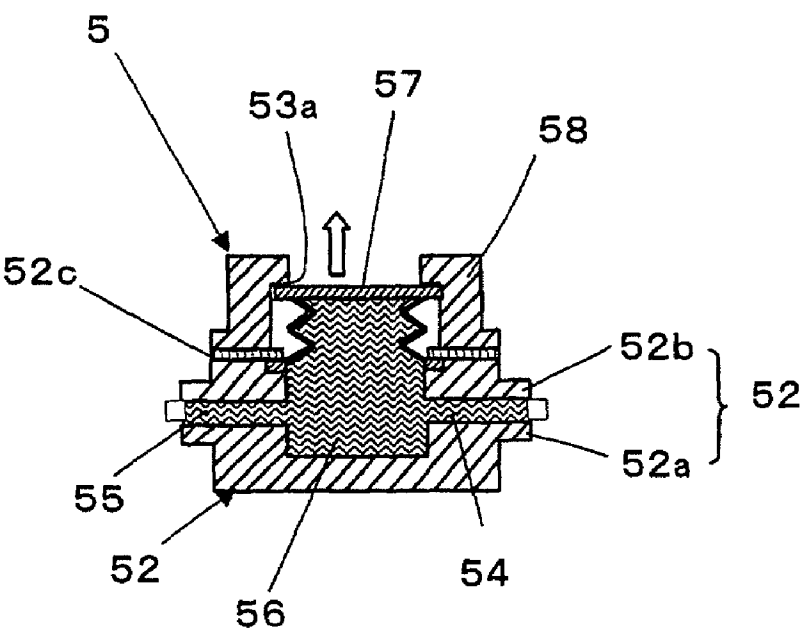
FIG. 14A is a sectional view showing a state that a bellows shaped movable member of the accumulator is expanded in the second embodiment.

In the accumulator 5 configured as above, the bellows type movable member 57 expands in a direction shown by arrow in FIG. 14A so as to increase the volume of the liquid accumulation cavity 56 of the accumulator 5 in the discharge operation of the diaphragm pump 1. Thus, exponential increase of the quantity of the discharged liquid can be absorbed. At this time, the bellows type movable member 57 cannot be expanded more than a predetermined height due to the stopper 58, so that the volume of the liquid accumulation cavity 56 of the accumulator 5 cannot be increased more than a predetermined volume. In the suction operation of the diaphragm pump 1, the bellows type movable member 57 is contracted in a direction shown by arrow in FIG. 14B so as to decrease the volume of the liquid accumulation cavity 56 of the accumulator 5 in the discharge operation of the diaphragm pump 1. Thus, the reduction of the quantity of the discharged liquid due to the occurrence of the back stream can be compensated.

In the second embodiment, the accumulator 5 having the bellows type moving member 57 which can move quickly is used, so that it is possible to respond the minute variation of the quantity of the discharged liquid due to the back stream generated by the motion of the discharge valve 16*b*, and the variation of the quantity of the liquid discharged from the outlet 55 of the accumulator 5 due to the occurrence of the back stream can be reduced. Furthermore, the configuration of the accumulator 5 in the second embodiment can be simplified, so that the productivity of the liquid discharge control apparatus can be increased.

Third Embodiment

Figure 15:
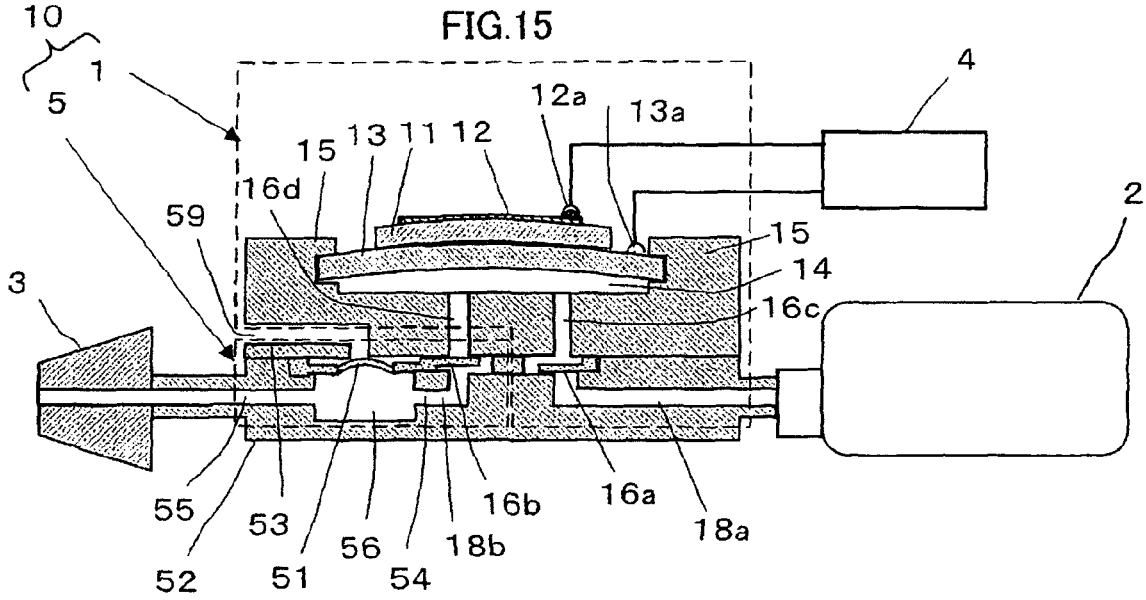
FIG. 15 is a sectional view showing a schematic configuration of the liquid discharge control apparatus in accordance with a third embodiment of the present invention.

A liquid discharge control apparatus with piezoelectric type diaphragm pump in accordance with a third embodiment of the present invention is described with reference to FIG. 15. In the third embodiment, the accumulator 5 and the diaphragm pump 1 are integrally constituted as a unified type pump 10.

In the unified type pump 10, the movable member 5 of the accumulator 5 made of an elastic film is unified with the discharge valve 16*b* of the diaphragm pump 1, and the outlet 16*d* disposed in the discharge valve 16*b* is directly connected to the inlet 54 of the accumulator 5 with no connection path. A communication path 59 into which an atmospheric are passes is provided between a rear face of the movable member 51 of the accumulator and an outer wall of the housing 15 of the diaphragm pump 1, so that the motion of the movable member 51 can be made smooth by the communication path 59. The liquid discharged from the discharge valve 16*b* is directly flown into the accumulator 5 through the outlet pipe arrangement 18*b*. The mechanism for reducing the influence due to the back stream generated by the motion of the discharge valve 16*b* is the same as that in the first and second embodiment.

In the third embodiment, since the diaphragm pump 1 and the accumulator 5 are integrated, a number of elements constituting the liquid discharge control apparatus can be reduced and the productivity of the liquid discharge control apparatus can be increased. Furthermore, since the discharge valve 16*b* and the movable member 51 of the accumulator 5 are directly connected, a length of the outlet pipe arrangement can be shortened, and thereby the resistance in the path of the liquid discharged from the discharge valve 16*b* can be reduced. Still furthermore, the response of the movable member 51 for the back stream in the discharged liquid can be increased, so that the motion of the accumulator 5 becomes smoother.

Fourth Embodiment

Figure 16:
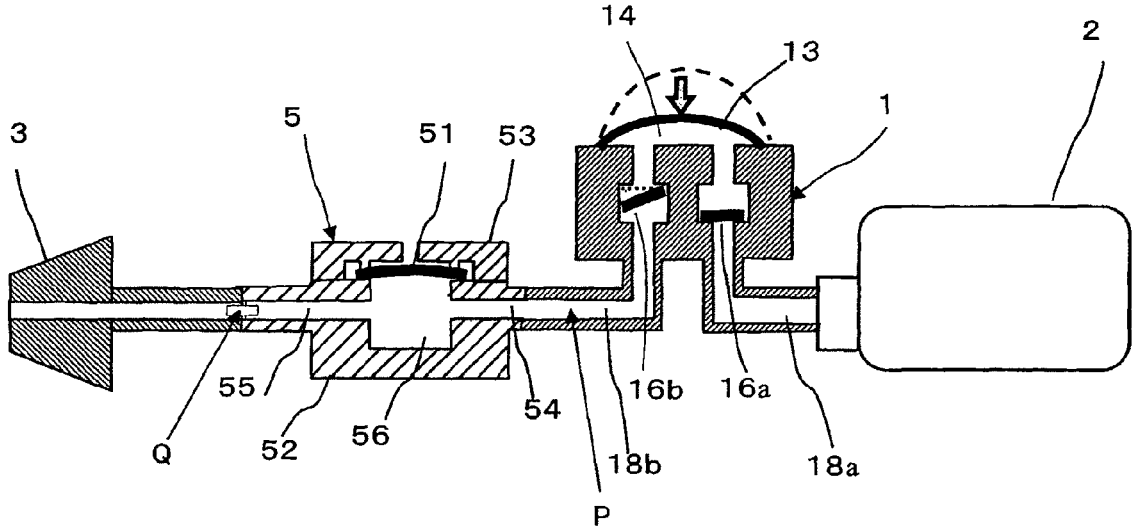
FIG. 16 is a sectional view showing a schematic configuration of the liquid discharge control apparatus in accordance with a fourth embodiment of the present invention.

A liquid discharge control apparatus with piezoelectric type diaphragm pump in accordance with a fourth embodiment of the present invention is described with reference to FIGS. 16, 17A and 17B. FIG. 16 shows a configuration of the liquid discharge control apparatus in the fourth embodiment.

In the fourth embodiment, the quantity of the discharged liquid which is reduced by the back stream of the discharge valve 16*b* of the diaphragm pump 1 and the quantity of the liquid compensated by the accumulator 5 are made substantially the same by adjusting the variation of the volume of the liquid accumulation cavity 56 of the accumulator 5 due to the elastic deformation of the movable member 51 properly in the liquid discharge control apparatus having substantially the same configuration as that in the first embodiment.

Figure 17A:
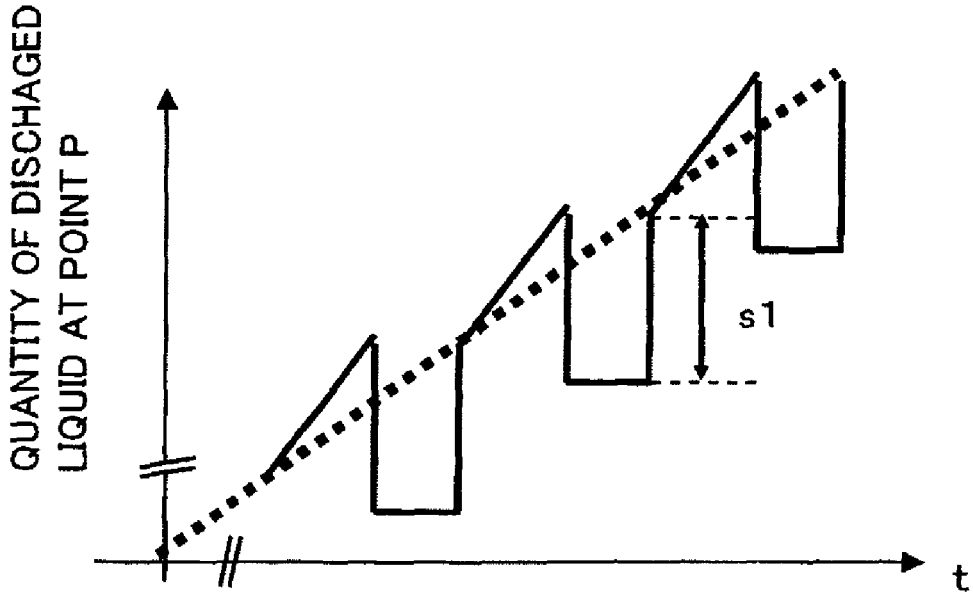
FIG. 17A is a graph showing variation of quantity of liquid at a point P in an outlet pipe arrangement of a diaphragm pump shown in FIG. 16.
Figure 17B:
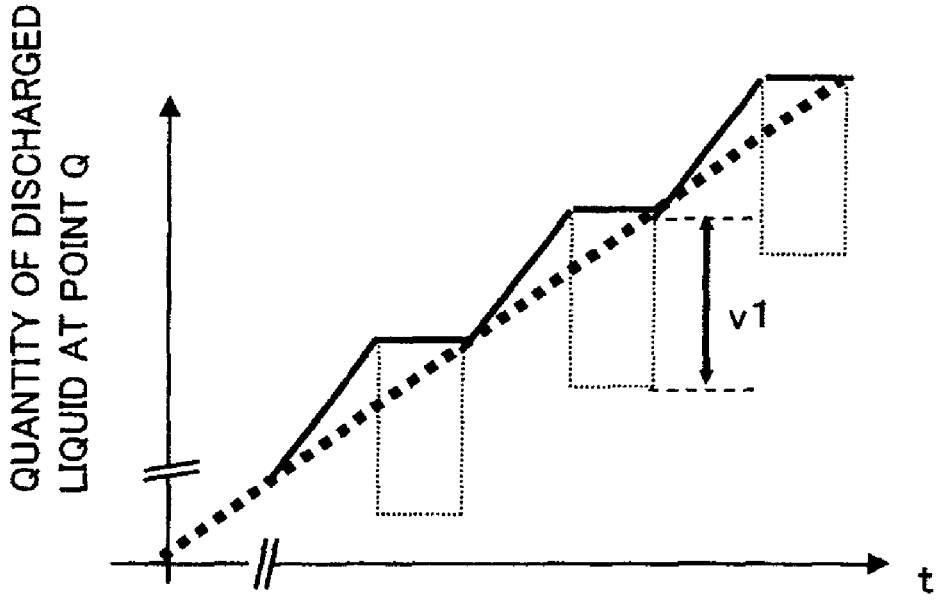
FIG. 17B is a graph showing variation of the quantity of the liquid at a point Q in an outlet of an accumulator in FIG. 16.

FIG. 17A shows a variation of the quantity of the liquid at a point P in the outlet pipe arrangement 18*b* of the diaphragm pump 1 in FIG. 16, and FIG. 17B shows a variation of the quantity of the liquid at a point Q in the outlet 55 of the accumulator 5. As shown in FIG. 17A, the reduction of the quantity s1 of the liquid occurs due to the back stream by the motion of the discharge valve 16*b* at the point P in the outlet pipe arrangement 18*b*. However, the reduction of the quantity of the discharge liquid at the point Q in the outlet 55 of the accumulator 5 can be compensated by the increase of the quantity v1 of the liquid discharged from the accumulator 5, as shown in FIG. 17B.

According to the configuration of the fourth embodiment, it is possible to obtain an effect of compensating the reduction of the quantity of the liquid discharged from the accumulator 5 due to the back stream by the motion of the discharge valve 16*b* of the diaphragm pump 1, so that the liquid discharge control apparatus of the forth embodiment can be used for controlling a minute quantity of the liquid.

Fifth Embodiment

Figure 18:
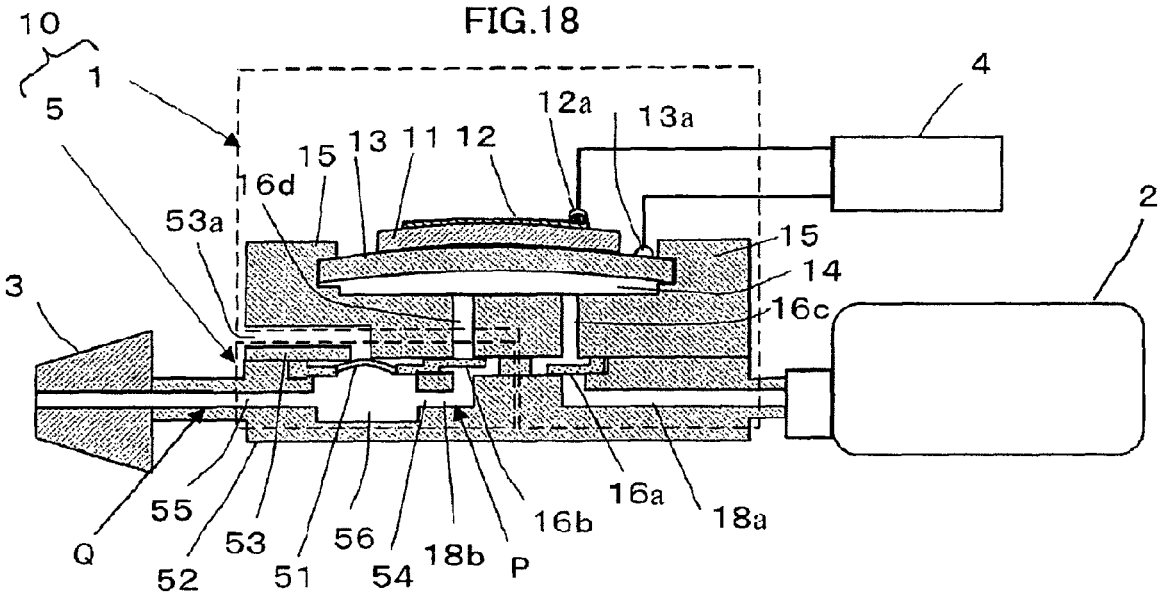
FIG. 18 is a sectional view showing a schematic configuration of the liquid discharge control apparatus in accordance with a fifth embodiment of the present invention.

A liquid discharge control apparatus with piezoelectric type diaphragm pump in accordance with a fifth embodiment of the present invention is described with reference to FIG. 18. FIG. 18 is a sectional view showing a schematic configuration of the liquid discharge control apparatus in the fifth embodiment.

In the fifth embodiment, the quantity of the discharged liquid which is reduced by the back stream of the discharge valve 16*b* of the diaphragm pump 1 and the quantity of the liquid compensated by the accumulator 5 are made substantially the same by adjusting the variation of the volume of the liquid accumulation cavity 56 of the accumulator 5 due to the elastic deformation of the movable member 51 properly in the liquid discharge control apparatus having substantially the same configuration as that in the third embodiment.

In the fifth embodiment, the quantity of the liquid is reduced due to the back stream by the motion of the discharge valve 16*b* at the point P in the outlet pipe arrangement 18*b*, but the reduction of the quantity of the discharge liquid at the point Q in the outlet 55 of the accumulator 5 can be compensated by the increase of the quantity of the liquid discharged from the accumulator 5, similar to the above-mentioned fourth embodiment. Although the liquid discharge control apparatus is configured in compact body, it is possible to restrict the minute variation of the quantity of the liquid discharge from the outlet 55 of the accumulator 5 and to discharge the liquid smoothly from the nozzle 3.

Sixth Embodiment

A liquid discharge control apparatus with piezoelectric type diaphragm pump in accordance with a sixth embodiment of the present invention is described. The liquid discharge control apparatus can have a configuration substantially the same as that of one of the above-mentioned embodiment, so that the illustration of the liquid discharge control apparatus is omitted. In the sixth embodiment, the natural vibration frequency of the movable member 51 or 57 of the accumulator 5 is made substantially the same as the oscillation frequency of the diaphragm pump 1.

The movable member 51 or 57 of the accumulator 5 inherently has a natural vibration frequency which is established by the configuration itself. Generally, a disc shaped diaphragm has a natural vibration frequency "F" defined by the following equation.

$$F=10.21(D/\beta\, d)^{0.5}/2\,\pi a^2$$

Hereupon, $$D=Ed^2/12(1-\alpha^2)$$

a: radius,
β: weight per unit volume,
d: thickness,
E: Young's modulus,
α: Poisson's ratio,
π: circle ratio The natural vibration frequency of the movable member 51 or 57 of the accumulator 5 is determined by substituting proper constants into the above-mentioned equations of the natural vibration frequency so as to make the natural vibration frequency of the moving member 51 or 57 of the accumulator 5 coincide with the oscillation frequency of the diaphragm pump 1. Under a condition that the natural vibration frequency of the moving member 51 or 57 of the accumulator 5 coincides with the oscillation frequency of the diaphragm pump 1, when the diaphragm pump 1 is driven, the movable member 51 or 57 of the accumulator 5 is vibrated by the back stream generated by the motion of the discharge valve 16*b* of the diaphragm pump 1. Since the natural vibration frequency of the movable member 51 or 57 coincides with the vibration due to the back stream, the vibration of the movable member 51 due to the back stream is magnified, and the deformation or displacement of the moving member 51 or 57 to the movable limits can be made smoother. Thereby, the effect for reducing the variation of the quantity of the liquid discharged from the liquid discharge control apparatus can be increased, and the liquid can be discharged smoother from the nozzle 3 of the liquid discharge control apparatus.

Seventh Embodiment

A liquid discharge control apparatus with piezoelectric type diaphragm pump in accordance with a seventh embodiment of the present invention is described with reference to FIGS. 19A to 19D. As can be seen from FIG. 19A, the liquid discharge control apparatus comprises a second accumulator 6 provided between the first accumulator 5 and the nozzle 3 further to the configuration in the first embodiment. The first accumulator 5 is used for reducing the variation of the quantity of the liquid discharged from the diaphragm pump 1 due to the back stream. The second accumulator 6 is used for reducing intermittent flow of the liquid.

By providing the second accumulator 6, it is possible to reduce the intermittent flow of the liquid caused by repetition of the discharge operation and the suction operation of the diaphragm pump 1. Thereby, the pulsation of the liquid discharge from the nozzle 3 can be reduced much more, so that the liquid can be discharged much smoother from the nozzle 3.

The second accumulator 6 has essentially the same configuration as that of the first accumulator 5, and specifically comprises a movable member 61, a housing 62, a guide 63 used for fixing a peripheral portion of the movable member 61 on the housing 62, and a liquid accumulation cavity 66 formed on the housing 62 for temporarily accumulating the liquid. The second accumulator 6 constitutes a circular diaphragm.

The movable member 61 is moved corresponding to the variation of the pressure of the intermittent flow of the liquid discharged from the diaphragm pump 1, so that it reduces the intermittent flow of the liquid by varying a volume of the liquid accumulation cavity 66. The elastic film of the movable member 61 warps outward by expansion itself corresponding to the increase of the quantity of the liquid in the liquid accumulation cavity 66, so that the volume of the liquid accumulation cavity 66 is increased. Alternatively, the movable member 61 warps inward by contraction corresponding to the decrease of the quantity of the liquid in the liquid accumulation cavity 66, so that the volume of the liquid accumulation cavity 66 is decreased. Consequently, the vibration due to the intermittent flow of the liquid can be absorbed by the elastic deformation of the movable member 61. In other words, the second accumulator 6 can reduce the exponential increase of the quantity of the liquid in the discharge operation and the exponential decrease of the liquid in the suction operation of the diaphragm pump 1.

In addition, it is possible that the second accumulator 6 is designed to absorb the pulsating flow due to only the intermittent flow of the liquid when no back stream occurs. When the variation of the quantity of the liquid flow due to the back stream can be reduces to substantially zero by the first accumulator 5, the second accumulator 6 can reduce the influence due to the intermittent flow of the liquid effectively. Consequently, the liquid transmission can be performed in a condition that the variation of the quantity of the liquid flow due to the back stream and the intermittent flow can be reduced.

Figure 19A:
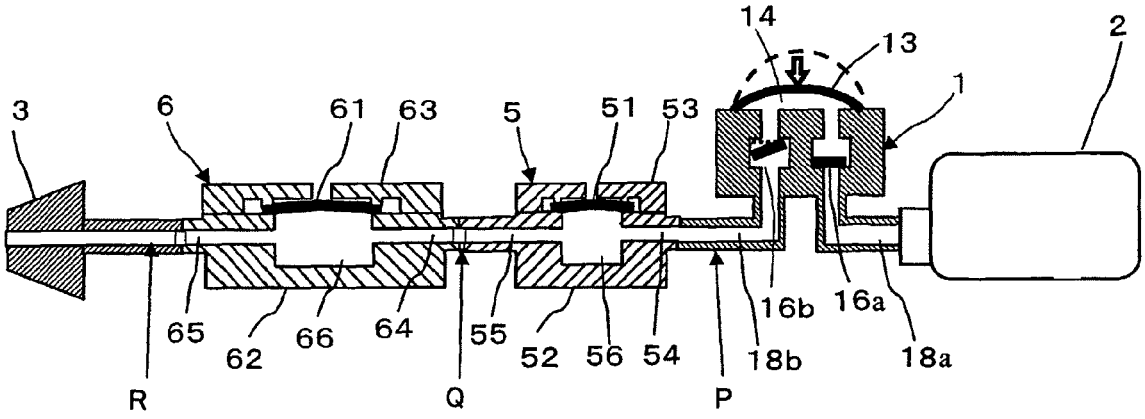
FIG. 19A is a sectional view showing a schematic configuration of the liquid discharge control apparatus in accordance with a seventh embodiment of the present invention.
Figure 19B:
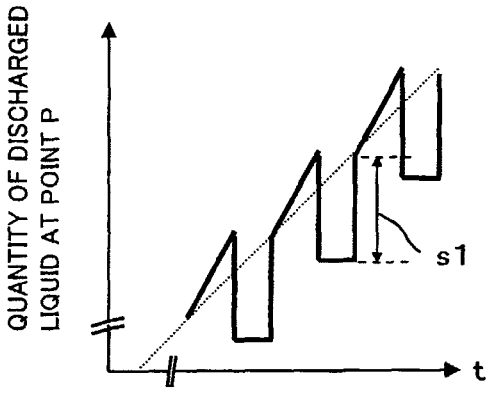
FIGS. 19B, 19C and 19D are graphs respectively showing variation of quantities of discharged liquid at points P, Q and R in FIG. 19A.
Figure 19C:
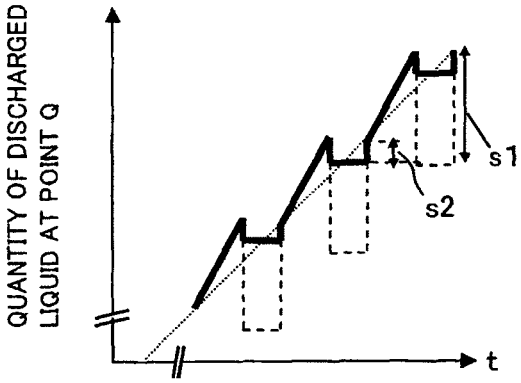
Figure 19D:
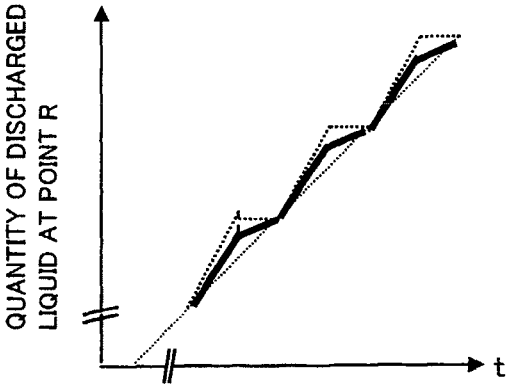

FIGS. 19B, 19C and 19D are graphs respectively showing the variation of the quantities of the discharged liquid at points P, Q and R in FIG. 19A. The point P is positioned in the outlet pipe arrangement 18*b* of the diaphragm pump 1, the point Q is positioned in the outlet 55 of the first accumulator 5 and the point R is positioned in the outlet 65 of the second accumulator 6. As can be seen from FIG. 19B, the quantity of the liquid discharge from the diaphragm pump 1 is reduce by the quantity s1 corresponding to the quantity of the back stream of the liquid during the suction operation. As can be seen from FIG. 19C, the reduction of the quantity of the liquid is compensated to the quantity s2 by the first accumulator 5. Furthermore, as can be seen from FIG. 19D, most of the reduction of the quantity of the liquid is compensated to zero by the second accumulator 6. Thereby, the smooth transmission of the liquid can be realized.

Eighth Embodiment

A liquid discharge control apparatus with piezoelectric type diaphragm pump in accordance with an eighth embodiment of the present invention is described with reference to FIGS. 20A to 20D. As can be seen from FIG. 20A, the liquid discharge control apparatus comprises a check valve 7 in a path between the first accumulator 5 and the second accumulator 6 further to the configuration in the seventh embodiment.

The check valve 7 has a valve member 71 made of an elastic material. When the diaphragm pump 1 discharges the liquid in the discharge operation, the valve member 71 of the check valve 7 is opened by the liquid flown from the diaphragm pump 1 through the first accumulator, so that the path communicating the first accumulator 5 and the second accumulator 6 is opened. Thereby, the liquid is discharged from the nozzle 3 of the liquid discharge control apparatus. At this time, the movable member 61 of the second accumulator 6 is elastically deformed, so that the volume of the liquid accumulation cavity 66 is increased.

When diaphragm pump 1 moves for the suction operation, the valve member 71 of the check valve 7 is closed by the pressure difference between the pressures at the front and rear portions of the valve member 71. Thereby, the back stream generated by the motion of the discharge valve 16*b* of the diaphragm pump 1 is compensated by the action of the first accumulator 5, so that the influence due to the back stream never reach to the liquid in the vicinity of the nozzle 3. Furthermore, the movable member 61 of the second accumulator 6 is deformed by the pressure difference, so that the suppliance of the liquid to the nozzle 3 is continued. Consequently, the pulsation of the liquid discharged from the nozzle 3 can be decreased.

Figure 20A:
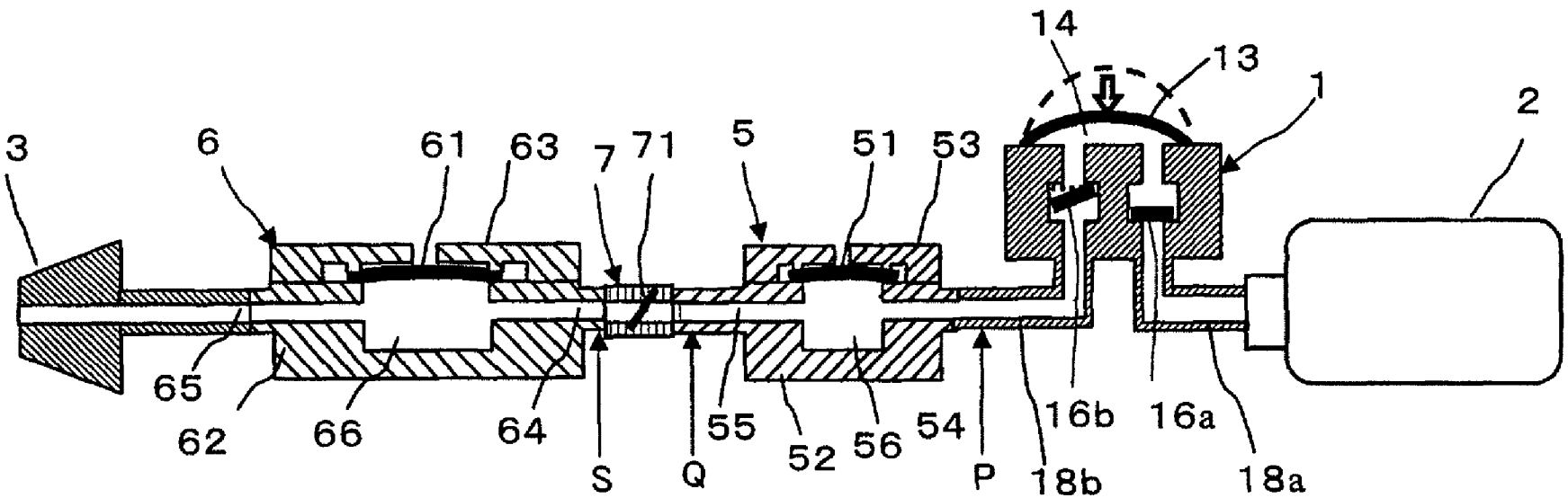
FIG. 20A is a sectional view showing a schematic configuration of the liquid discharge control apparatus in accordance with an eighth embodiment of the present invention.
Figure 20B:
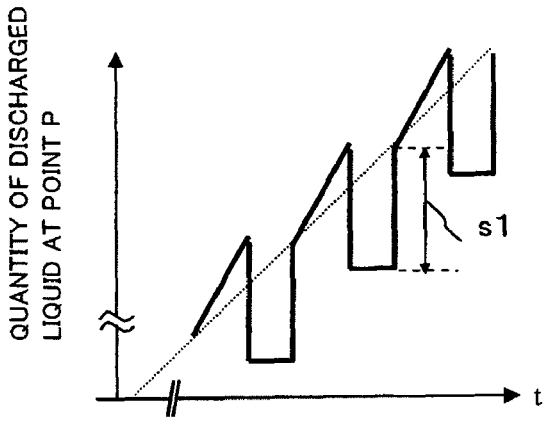
FIGS. 20B, 20C and 20D are graphs respectively showing variation of quantities of discharged liquid at points P, Q and S in FIG. 20A.
Figure 20C:
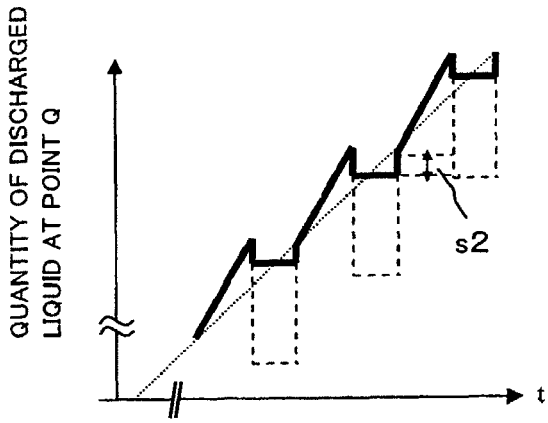
Figure 20D:
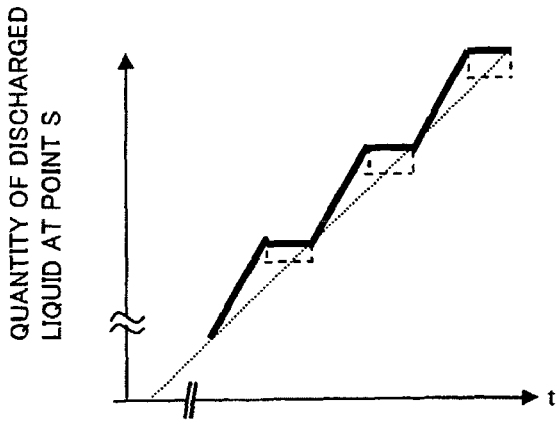

FIGS. 20B, 20C and 20D are graphs respectively showing the variation of the quantities of the discharged liquid at points P, Q and S in FIG. 20A. The point P is positioned in the outlet pipe arrangement 18*b* of the diaphragm pump 1, the point Q is positioned in the outlet 55 of the first accumulator 5 and the point S is positioned in the outlet of the check valve 7 (or the inlet 64 of the second accumulator 6). As can be seen from FIG. 20B, the quantity of the liquid discharge from the diaphragm pump 1 is reduce by the quantity s1 corresponding to the quantity of the back stream of the liquid during the suction operation. As can be seen from FIG. 20C, the reduction of the quantity of the liquid is compensated to the quantity s2 by the first accumulator 5. Furthermore, as can be seen from FIG. 20D, the reduction of the quantity of the liquid is further reduced by the check valve 7, and thereby, the smooth transmission of the liquid can be realized.

Ninth Embodiment

Figure 21A:
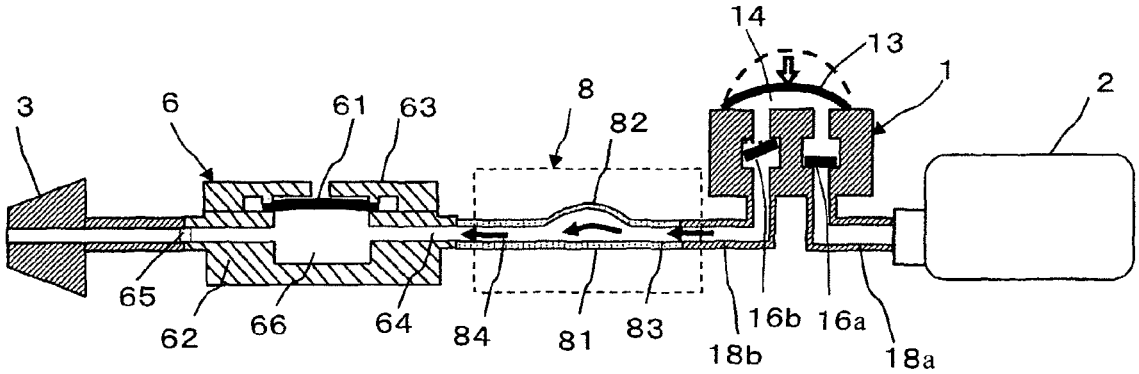
FIG. 21A is a sectional view showing a schematic configuration of the liquid discharge control apparatus in accordance with a ninth embodiment of the present invention.

A liquid discharge control apparatus with piezoelectric type diaphragm pump in accordance with a ninth embodiment of the present invention is described with reference to FIGS. 21A and 21B. FIG. 21A shows a configuration of the liquid discharge control apparatus in the ninth embodiment. In the ninth embodiment, a modified first accumulator 8 which has a movable member 82 in a part of a pipe arrangement 81 is provided between the diaphragm pump 1 and the second accumulator 6 instead of the first accumulator 5, in comparison with the seventh embodiment.

Figure 21B:
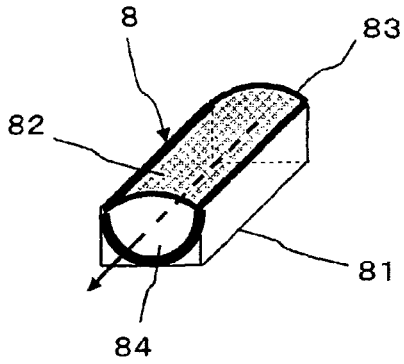
FIG. 21B is a perspective view showing a configuration of a modified first accumulator in the ninth embodiment.

FIG. 21B shows the configuration of the first accumulator 8. The modified first accumulator 8 comprises a movable member 82 made of an elastic film which is fixed on a part of the pipe arrangement 81. In the discharge operation of the diaphragm pump 1, the discharge liquid is flown into the pipe arrangement 81 from an inlet 83, so that the. quantity of the liquid in the pipe arrangement 81 suddenly increases. The movable member 82 is elastically deformed to warp outward by the increased quantity (or increased pressure) of the liquid, so that the volume in the liquid accumulation cavity of the pipe arrangement 81 is increased. Thereby, the increase of the quantity (or increase of the pressure) of the liquid in the pipe arrangement 81 can be absorbed. Alternatively, in the suction operation of the diaphragm pump 1, the movable member 82 is deformed to warp inward, so that the volume of the liquid accumulation cavity of the pipe arrangement 81 is decreased. Thereby, the liquid in which the influence of the back stream is reduced is discharged from the modified first accumulator 8.

Tenth Embodiment

A liquid discharge control apparatus with piezoelectric type diaphragm pump in accordance with a tenth embodiment of the present invention is described. The configuration of the liquid discharge control apparatus in the tenth embodiment is substantially the same as that in the seventh embodiment, so that the illustration of the liquid discharge control apparatus is omitted. In the tenth embodiment, the natural vibration frequency of the movable member 51 of the first accumulator 5 and the natural vibration frequency of the movable member 61 of the second accumulator 6 are made to coincide with the oscillation frequency of the diaphragm pump 1. The natural vibration frequencies of the movable member 51 of the first accumulator 5 and the movable member 61 of the second accumulator 6 are the above-mentioned mechanical natural vibration frequencies inherently established by the configurations of the movable members of the accumulators.

Under a condition that the natural vibration frequency of the movable member 51 of the first accumulator 5 substantially coincides with the oscillation frequency of the diaphragm pump 1, when the diaphragm pump 1 is driven, the movable member 51 is vibrated by pulsating flow of the liquid due to back stream occurred in the diaphragm pump 1. Since the frequency of the vibration of the movable member 51 coincides with the natural vibration frequency thereof, the amplitude of the vibration, that is, the motion of the movable member 51 is magnified. Thereby, the movable member 51 can be deformed or displaced to the movable limits, smoothly. Similarly, under a condition that the natural vibration frequency of the movable member 61 of the second accumulator 6 substantially coincides with the oscillation frequency of the diaphragm pump 1, when the diaphragm pump 1 is driven, the movable member 61 is vibrated by pulsating flow of the liquid discharge from the first accumulator 5. Since the frequency of the vibration of the movable member 61 coincides with the natural vibration frequency thereof, the amplitude of the vibration, that is, the motion of the movable member 61 is magnified. Thereby, the movable member 61 can be deformed or displaced to the movable limits, smoothly. By such a configuration, the effects for reducing the reduction of the quantity of the liquid flow due to the back stream and the intermittent flow of the liquid can be increased, so that the liquid can be discharged from the nozzle 3, smoothly.

Eleventh Embodiment

Figure 22A:
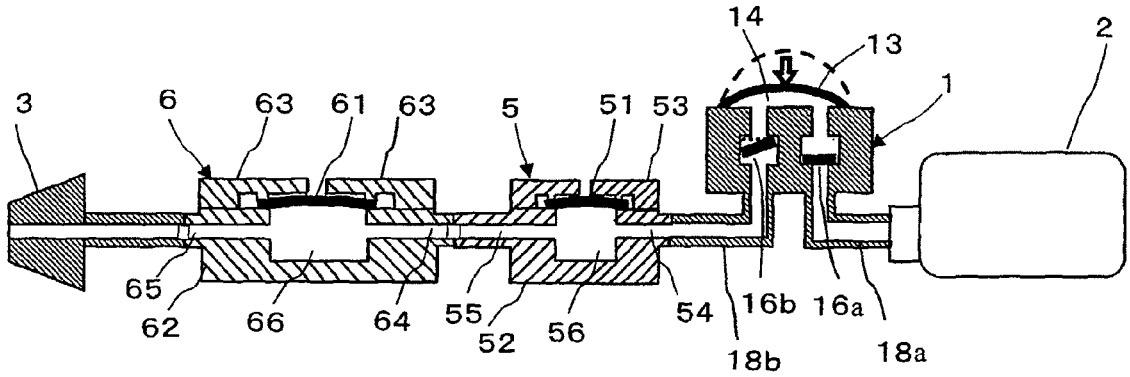
FIG. 22A is a sectional view showing a schematic configuration of the liquid discharge control apparatus in accordance with an eleventh embodiment of the present invention.

A liquid discharge control apparatus with piezoelectric type diaphragm pump in accordance with an eleventh embodiment of the present invention is described with reference to FIGS. 22A to 22E. FIG. 22A shows a configuration of the liquid discharge control apparatus in the eleventh embodiment. In the eleventh embodiment, the movable member 61 of the second accumulator 6 is configured so that it can easily be deformed in a direction for increasing the volume of the liquid accumulation cavity 66 but cannot easily be deformed in a direction for decreasing the volume of the liquid accumulation cavity 66.

Figure 22B:
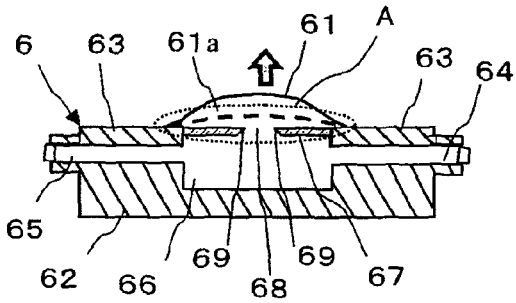
FIG. 22B is a sectional view showing a state of a second accumulator in discharge operation of a diaphragm pump in the eleventh embodiment.
Figure 22C:
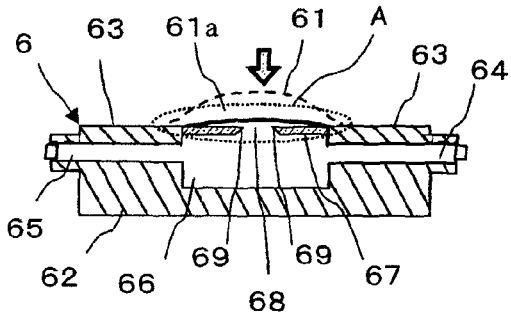
FIG. 22C is a sectional view showing a state of the second accumulator in the suction operation of the diaphragm pump in the eleventh embodiment.
Figure 22D:
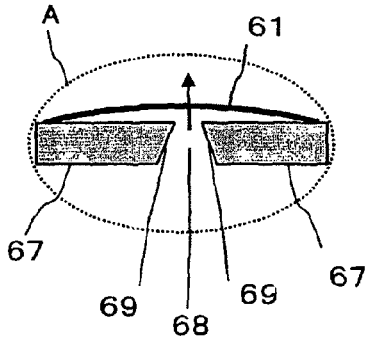
FIG. 22D is a sectional vies showing a portion designated by a symbol "A" in FIGS. 22B and 22C.

FIG. 22B shows a state of the second accumulator 6 in the discharge operation of the diaphragm pump 1 and FIG. 22C shows a state of the second accumulator 6 in the suction operation of the diaphragm pump 1. FIG. 22D shows a portion designated by a symbol "A" in FIGS. 22B and 22C.

The second accumulator 6 comprises a partition 67 having a small aperture 68 in the liquid accumulation cavity 66 so that the space between the movable member 61 and the partition 67 can be separated as a volume changing portion 61*a*. In the discharge operation of the diaphragm pump 1, the liquid flows into the volume changing portion 61*a* through the aperture 68. Alternatively, in the suction operation of the diaphragm pump 1, the liquid in the volume changing portion 61*a* is drained through the aperture 68. A tapered face 69 is formed on an edge of the aperture 68 so that the width of the aperture 68 is gradually made narrower toward the volume changing portion 61*a*. Thereby, the resistance due to the partition 67 against the liquid flowing through the aperture 68 differs in the direction of the liquid flow.

By such a configuration, when the liquid flows into the volume changing portion 61*a* in the discharge operation, the resistance due to the partition 67 is reduced by the tapered face 69 of the aperture 68, so that the liquid can flow into the volume changing portion 61*a*, smoothly. Thereby, the volume of the liquid accumulation cavity 66 can be increased quickly corresponding to the increase of the quantity or pressure of the liquid.

Alternatively, when the liquid is drain from the volume changing portion 61*a*, the resistance due to the partition 67 is not reduced by the tapered face 69 of the aperture 68, so that the liquid cannot drained from the volume changing portion 61*a*, smoothly. Thereby, the volume of the liquid. accumulation cavity 66 can be decreased slowly corresponding to the decrease of the quantity or pressure of the liquid.

Figure 22E:
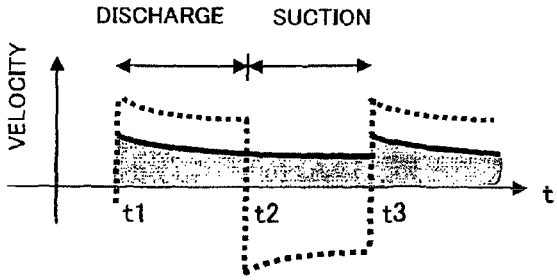
FIG. 22E is a graph showing variation in time of instantaneous velocity or quantity of liquid flown in a liquid accumulation cavity of the second accumulator in the eleventh embodiment.

FIG. 22E shows variation in time of the instantaneous velocity or quantity of the liquid flown in the liquid accumulation cavity 66 of the second accumulator 6. The dotted line designates the variation of the instantaneous velocity of the liquid flow when the tapered face 69 is not formed on the edge of the aperture 68. The solid line designates the variation of the instantaneous velocity of the liquid flow when the tapered face 69 is formed on the edge of the aperture 68. In case that the tapered face 69 is formed, the instantaneous velocity of the liquid flow is varied little in the discharge term t1 to t2 and the suction term t2 to t3. In other words, the rapid pulsation in the discharged liquid is reduced. By such a configuration, although the configuration of the second accumulator 6 becomes a little complex by providing the separator 67 in comparison with the seventh embodiment, the second accumulator 6, however, can reduce the pulsation of the liquid flow discharged from the first accumulator, much more. Thus, the liquid can be discharged from the nozzle 3 much smoother.

This application is based on Japanese patent applications 2004-372237 and 2005-275290 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

INDUSTRIAL APPLICABILITY

As mentioned above, the liquid discharge control apparatus in accordance with the present invention comprises the accumulator having a passive pulsation reduction function provided between the piezoelectric type diaphragm pump and the nozzle. The accumulator has a movable member which is elastically deformed corresponding to increase and decrease the quantity or pressure of the liquid flown in the accumulator, so that the volume of the liquid accumulation cavity of the accumulator can be increased and decreased. Thus, the pulsation, that is, the increase and decrease of the quantity or pressure of the liquid flow can be absorbed by the accumulator, and the liquid can be discharged from the nozzle, smoothly.

The invention claimed is:

1. A liquid discharge control apparatus, comprising:

a piezoelectric type diaphragm pump having a discharge valve which is opened and closed by a pressure difference and a piezoelectric element that serves as a driving actuator; and a first accumulator that communicates with an outlet of the diaphragm pump, and has a liquid accumulation cavity and a movable member which is elastically deformed by variation of a quantity of a liquid flowing into the liquid accumulation cavity so as to increase and decrease a volume of the liquid accumulation cavity corresponding to an increase and decrease of the quantity of the liquid, wherein the movable member has a center portion which is elastically deformable by a pressure of the liquid and a peripheral portion fixed on a housing;

the center portion has an initial equilibration state which is previously concaved in a predetermined direction and a deformed equilibration state which is previously convexed in an opposite direction; and the movable member is deformed between the initial equilibration state and the deformed equilibration state, the discharge valve of the diaphragm pump and the movable member of the first accumulator being unified, the outlet of the diaphragm pump being directly connected to an inlet of the accumulator with no connection path.

2. The liquid discharge control apparatus in accordance with claim 1, wherein a quantity of the liquid which flows backward due to a back stream generated by a motion of the discharge valve of the diaphragm pump is substantially the same as a quantity of the liquid compensated by the decrease of the volume of the liquid accumulation cavity of the first accumulator.

3. The liquid discharge control apparatus in accordance with claim 1, wherein a natural vibration frequency of the movable member of the first accumulator substantially coincides with an oscillation frequency of the diaphragm pump.

4. The liquid discharge control apparatus in accordance with claim 1, wherein the movable member is an elastic membrane.

5. The liquid discharge control apparatus in accordance with claim 1, wherein an initial equilibration state of the movable member corresponds to a state where the pressure of the liquid becomes a first value due to an occurrence of a back stream and a volume of the liquid accumulation cavity becomes a first quantity, a deformed equilibration state of the movable member corresponding to a state where the pressure of the liquid becomes a second value that is greater than the first value due to no back stream and the volume of the liquid accumulation cavity becomes a second quantity that is greater than the first quantity.

* * * * *